US007077792B2

(12) United States Patent
Nerenberg

(10) Patent No.: US 7,077,792 B2
(45) Date of Patent: Jul. 18, 2006

(54) PORTABLE EXERCISE APPARATUS

(76) Inventor: Arnold P. Nerenberg, 7238 S. Painter Ave., Whittier, CA (US) 90602

( * ) Notice: Subject to any disclaimer, the term of this patent is extended or adjusted under 35 U.S.C. 154(b) by 120 days.

(21) Appl. No.: 10/806,807

(22) Filed: Mar. 23, 2004

(65) Prior Publication Data

US 2005/0215400 A1 Sep. 29, 2005

(51) Int. Cl.
*A63B 21/02* (2006.01)

(52) U.S. Cl. ..... 482/121; 482/123; 482/130

(58) Field of Classification Search ..... 482/129, 482/130, 142, 123, 127; 297/250.1, 254, 297/256.13
See application file for complete search history.

(56) References Cited

U.S. PATENT DOCUMENTS

| | | | | |
|---|---|---|---|---|
| 1,973,945 | A * | 9/1934 | Chavin et al. | 482/130 |
| 4,784,121 | A | 11/1988 | Brooks | |
| 4,815,732 | A | 3/1989 | Mahvi | |
| 5,234,394 | A | 8/1993 | Wilkinson | |
| 5,616,111 | A * | 4/1997 | Randolph | 482/133 |
| 5,730,688 | A | 3/1998 | Prusick | |
| 5,743,838 | A | 4/1998 | Willis | |
| 5,860,897 | A | 1/1999 | Gilbert et al. | |
| 6,013,014 | A | 1/2000 | Hern | |
| 6,022,303 | A * | 2/2000 | Abdo | 482/140 |
| 6,110,081 | A | 8/2000 | Barrett | |
| 6,117,056 | A | 9/2000 | Cataldi, Jr. et al. | |
| 6,146,317 | A | 11/2000 | Prusick | |
| 6,440,046 | B1 * | 8/2002 | Tholkes | 482/142 |
| 6,461,283 | B1 | 10/2002 | Maron | |
| 6,500,104 | B1 * | 12/2002 | Rich | 482/123 |
| 6,755,463 | B1 * | 6/2004 | Lardieri et al. | 297/35 |

* cited by examiner

*Primary Examiner*—Jerome W. Donnelly
*Assistant Examiner*—Allana Lewin
(74) *Attorney, Agent, or Firm*—Schmeiser, Olsen & Watts

(57) ABSTRACT

A method and structure for exercising with a portable exercise apparatus. The portable exercise apparatus comprises a body support structure and at least one exercising structure. The a body support structure comprises a sitting structure pivotally attached to a back support structure. The back support structure may be positioned at a plurality of angular positions with respect to the sitting structure. The body support structure is adapted to be placed on a supporting structure. The at least one exercising structure is removably attached to the body support structure. The at least one exercising structure comprises a first resilient structure movably attached to a second resilient structure, a first attachment device, and a resistance means for applying a preset amount of resistance against movement of the first resilient structure with respect to the second resilient structure. The attachment device is adapted to removably attach the second resilient structure to the body support structure. The portable exercise apparatus is portable with respect to the supporting structure.

55 Claims, 22 Drawing Sheets

PORTABLE EXERCISE APPARATUS

BACKGROUND OF THE INVENTION

1. Technical Field

The present invention relates to an apparatus and associated method to exercise.

2. Related Art

Exercising typically requires time taken from other activities. Accordingly, there is a need to provide a means to exercise without taking time from other activities.

SUMMARY OF THE INVENTION

The present invention provides a portable exercise apparatus comprising:

a body support structure comprising a sitting structure pivotally attached to a back support structure, wherein the back support structure is adapted to be positioned at a plurality of angular positions with respect to the sitting structure, and wherein the body support structure is adapted to be placed on a supporting structure; and at least one exercising structure adapted to be removably attached to the body support structure, wherein the at least one exercising structure comprises a first resilient structure movably attached to a second resilient structure, a first attachment device, and a resistance means for applying a preset amount of resistance against movement of the first resilient structure with respect to the second resilient structure, wherein the attachment device is adapted to removably attach the second resilient structure to the body support structure, and wherein the portable exercise apparatus is portable with respect to the supporting structure.

The present invention a provides a method for exercising comprising:

providing a portable exercise apparatus comprising: a body support structure and at least one exercising structure, wherein the support structure comprises a sitting structure pivotally attached to a back support structure, wherein the back support structure is adapted to be positioned at a plurality of angular positions with respect to the sitting structure, wherein the at least one exercising structure comprises a first resilient structure movably attached to a second resilient structure, a first attachment device, and a resistance means for applying a preset amount of resistance against movement of the first resilient structure with respect to the second resilient structure;

placing the body support structure on a supporting structure, wherein the portable exercise structure is portable with respect to the supporting structure;

removably attaching by the first attachment device, the at least one exercising structure to the body support structure; and moving against a preset amount of resistance provided by the resistance means, the first resilient structure with respect to the second resilient structure.

The present invention advantageously provides a structure and associated method to exercise without taking time from other activities.

DETAILED DESCRIPTION OF THE INVENTION

Figure 1:
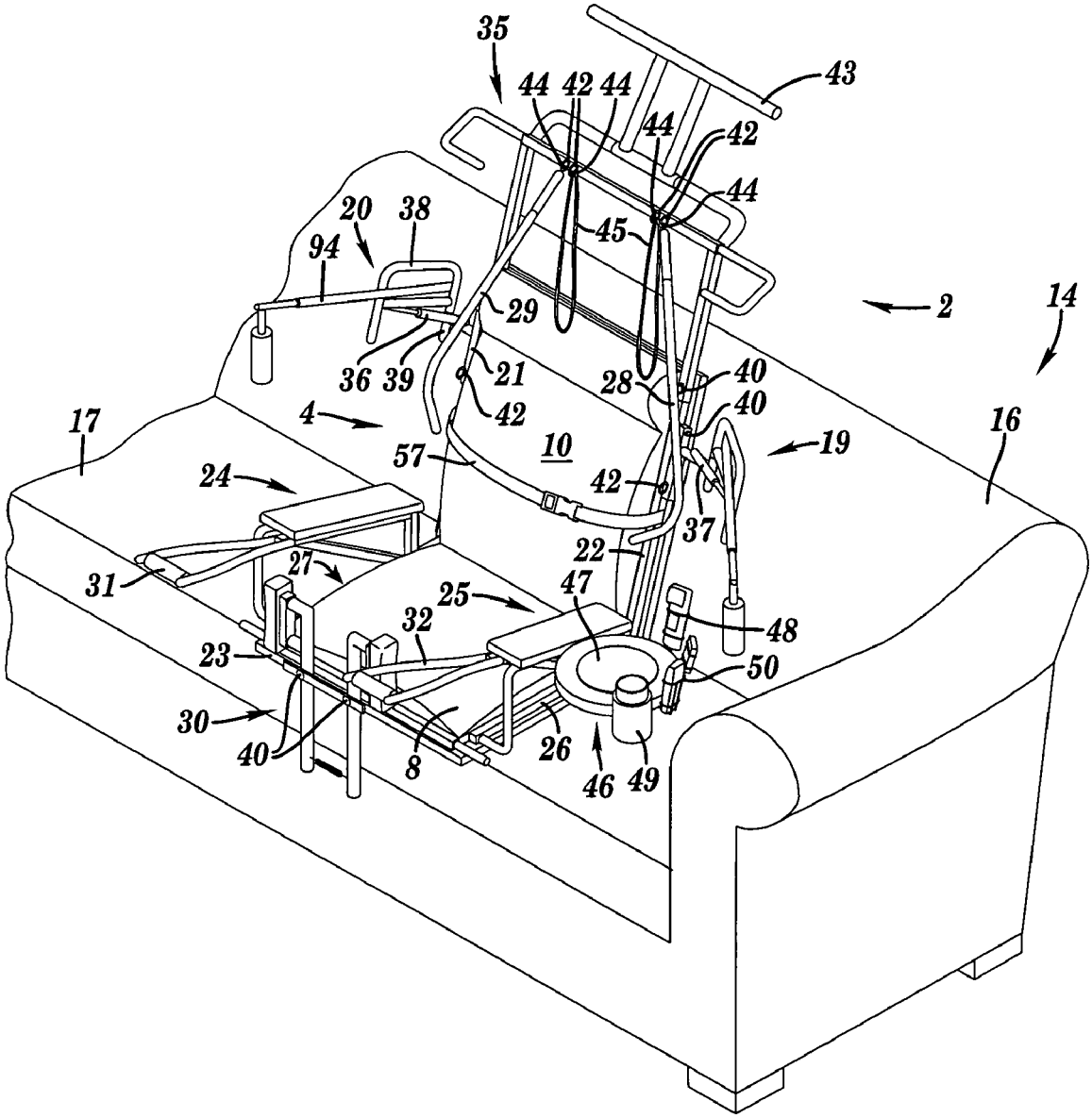
FIG. 1 illustrates a three dimensional view of a portable exercise apparatus comprising a body support structure and a plurality of removably attachable exercising structures, in accordance with embodiments of the present invention.

FIG. 1 illustrates a three dimensional view of a portable exercise apparatus 2 comprising a body support structure 4 and removably attachable exercising structures 19, 20, 28, 29, 30, 31, 32 and 43, in accordance with embodiments of the present invention. The body support structure 4 comprises a sitting structure 8 pivotally attached to a back support structure 10. The sitting structure 8 is pivotally attached to a back support structure 10 using a pivot device 68 (see FIG. 4). The pivot device 68 may be any pivot device known to a person of ordinary skill in the art such as, inter alia, a hinge(s), a piano hinge, etc. The back support structure 10 may be positioned at a plurality of angular positions with respect to the sitting structure 8. The body support structure 4 is adapted be placed on a supporting structure 14 during exercising (i.e., using the attachable exercising structures 19, 20, 28, 29, 30, 31, 32, and 43). Note that although the supporting structure 14 illustrated in FIG. 1 is a couch, the supporting structure 14 may be any supporting structure known to a person of ordinary skill in the art such as, inter alia, a chair, an automobile seat, a wheel chair, a bed, a hospital bed, a hotel bed, etc. The back support structure 10 is positioned at an angular position with respect to the sitting structure 8 that follows an angular position of the supporting structure 14. For example, a backrest 16 of the supporting structure 14 is positioned at an angular position of about 90° with respect to a seat 17 of the supporting structure 14 so the back support structure 10 is positioned at an angular position of about 90° with respect to the sitting structure 8 when the body support structure 4 is placed on the supporting structure 14 to ensure a proper fit. Alternatively, the supporting structure 14 may be a ground surface (e.g., a floor, a carpeted floor, etc) and the body support structure 4 may be placed on the ground surface (e.g, as shown in FIGS. 18–22). The back support structure 10 may be positioned at an angular position of about 180° with respect to the sitting structure 8 when the body support structure 4 is placed on a ground surface (e.g, as shown in FIGS. 18–22) so that a user (e.g., person 145 in FIGS. 18–22) may lay down on the body support structure 4 while exercising (i.e., using the removably attachable exercising structures 19, 20, 28, 29, 30, 31, 32, and 43). The body support structure 4 may be folded (e.g., place the back support structure 10 about parallel to the sitting structure 8 with an angle of about 0° between the back support structure 10 and the sitting structure 8) for storage. The removably attachable exercising structures include, inter alia, exercising structures 19, 20, 28, 29, 30, 31, and 32, 33 (see FIG. 2), 34 (see FIG. 3), and 43. The term "removably attached" is defined herein and including in the claims as a temporary attachment of a first structure (e.g.,exercising structures 19, 20, 28, 29, 30, 31, and 32, 33 (see FIG. 2), 34 (see FIG. 3), and 43) to a second structure (e.g. body support structure 4) during an overall use of said structures (e.g., exercising with the portable exercise apparatus 2). The removably attachable exercising structures 19, 20, 28, 29, 30, 31, and 32, 33 (see FIG. 2), 34 (see FIG. 3), and 43 may be used to strengthen, inter alia, arm muscles, chest muscles, back muscles, shoulder muscles, leg muscles, etc. The body support structure 4 additionally comprises elongated members 21, 22, 23, 26, and 27 mechanically attached. The removably attachable exercising structure 19 is removably attached to the elongated member 22. The removably attachable exercising structure 20 is removably attached to the elongated member 21. The removably attachable exercising structure 30 is removably attached to the elongated member 23. An armrest structure 24 comprising the exercising structure 31 is removably attached to the elongated member 27. An armrest structure 25 comprising the exercising structure 32 is removably attached to the elongated member 26. The removably attachable exercising structures 19, 20, and 30 and the armrest structures 24 and 25 are removably attached to the elongated members 21, 22, 23, 26, and 27 using fastening devices 40. The fastening devices 40 may be any fastening devices know to a person of ordinary skill in the art including, inter alia, screws, bolts, eye bolts, locking pins, etc. The locking pins may include, inter alia, positive locking pins, ball lock pins, wire lock pins, locking cotters, etc. Additionally, the portable exercise structure 2 may comprise a frame structure 35 removably attached to the elongated members 21 and 22. The frame structure 35 maybe used for isometric exercises. The frame structure 35 is removably attached to the elongated members 21 and 22 using fastening devices 40. The removably attachable exercising structure 43 is pivotally attached to the frame structure 35. The elongated members 21, 22, 26, and 27 and the frame structure 35 each comprise a plurality of hooking devices 42. The exercising structures 28 and 29 each comprise a latching device 44 that is used to removably attach the exercising structures 28 and 29 to each of the plurality of hooking devices 42 on each of the elongated members 21, 22, 26, and 27 and the frame structure 35. Each of the plurality of hooking devices may be any hooking device known to a person of ordinary skill in the art including, inter alia, eye bolts, hooks, etc. The latching device 44 may be any latching device known to a person of ordinary skill in the art such as, inter alia, a bolt snap, a trigger snap, a spring snap, a breaching snap, a carabiner, etc. Each of the exercising structures 19, 20, 28, 29, 30, 31, and 32, 33 (see FIG. 2), 34 (see FIG. 3), and 43 comprises a resistance means (e.g., resistance means 36 and 37) to apply a preset amount of resistance against movement of resilient structure(s) comprised by each of said exercising structures 19, 20, 28, 29, 30, 31, and 32, 33 (see FIG. 2), and 34 (see FIG. 3), and 43. The term "resistance means" is defined herein and including in the claims as a structure to apply resistance against movement of resilient structure(s) and may include, inter alia, a spring(s), an elastic band(s), a resistance band(s), a pneumatic resistance device, a hydraulic resistance device, etc. For example, the exercising structure 20 comprises a resilient structure 38 movably attached to a resilient structure 39. The resistance means 36 applies a preset amount of resistance against movement of the resilient structure 38 with respect to the resilient structure 39. The resilient structure 38 is engaged by a users limb (e.g, an arm, a leg, etc.). The resistance means 36 may comprise any resistance means known to a person of ordinary skill in the art including, inter alia, a spring(s), an elastic band(s), a resistance band(s), a pneumatic resistance device, a hydraulic resistance device, etc. Each of the exercising structures 19, 20, 28, 29, 30, 31, 32, 33 (see FIG. 2), 34 (see FIG. 3), and 43 are adapted to be engaged by a users limb (e.g, an arm, a leg, etc.). The portable exercise apparatus 2 may additionally comprise at least one resistance band 45 and an accessory holding structure 46. The at least one resistance band 45 is adapted to be engaged by a users limb (e.g, an arm, a leg, etc.) to apply a preset amount of resistance against movement of the users limb during exercising. The at least one resistance band 45 may be used to strengthen, inter alia, arm muscles, chest muscles, back muscles, shoulder muscles, leg muscles, etc. The resistance band may be any resistance band known to a person of ordinary skill in the art including, inter alia, an elastic band comprising rubber. The at least one resistance band 45 comprises a latching device 44 that is used to removably attach the at least one resistance band 45 to each of the plurality of hooking devices 42 on each of the elongated members 21, 22, 26, and 27 and the frame structure 35. The latching device 44 may be any latching device known to a person of ordinary skill in the art such as, inter alia, a bolt snap, a trigger snap, a spring snap, a breeching snap, a carabiner, etc. The accessory holding structure 46 may be removably attached to any the elongated members 21, 22, 23, 26, and 27 or either of the armrest structures 24 or 25 using the fastening devices 40. The accessory holding structure 46 comprises structures 47, 48, 49, and 50. Structure 47 is a mouse pad for using a computer mouse. Structures 48, 49, and 50 are holding structures for holding accessaries such as, inter alia, a glass, cup, or mug, a remote control (for T.V., VCR, DVD player, stereo equipment, etc.), a telephone (cordless, cellular, etc.), etc. A strapping structure 57 may be removably attached to either the back support 10 (as shown in FIG. 1) or sitting structure 8. The strapping structure 57 is adapted to strap or hold a user in a specific position during exercising. Note that the exercising structures 19, 20, 28, 29, 30, 31, 32, 33 (see FIG. 2), 34 (see FIG. 3), and 43 are shown in their respective locations on the body support structure 4 for illustration purposes only and that the exercising structures 19, 20, 28, 29, 30, 31, 32, 33 (see FIG. 2), 34 (see FIG. 3), and 43 may be placed at any location on the body support structure 4.

Figure 2:
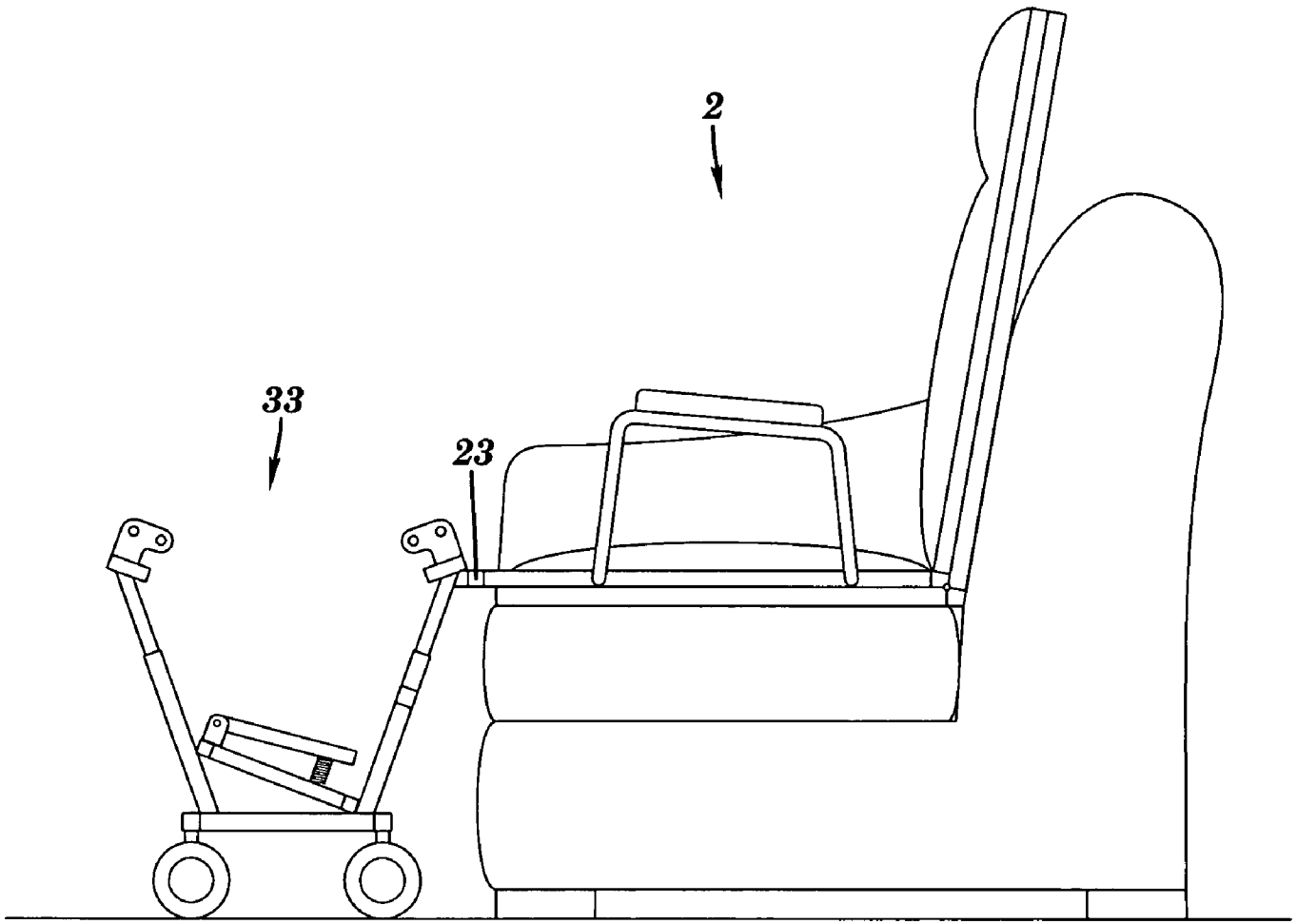
FIG. 2 illustrates a side view of an alternative embodiment for the portable exercise apparatus of FIG. 1, in accordance with embodiments of the present invention.

FIG. 2 illustrates a side view of the portable exercise apparatus 2 of FIG. 1 additionally comprising a removably attachable exercising structure 33, in accordance with embodiments of the present invention. In contrast with FIG. 1, FIG. 2 shows the portable exercise apparatus 2 with the removably attachable exercising structure 30 removed and replaced by the removably attachable exercising structure 33. The removably attachable exercising structured 33 is removably attached to the elongated member 23 using fastening devices 40. The portable exercise apparatus 2 of FIG. 2 is shown with the exercising structures 19, 20, 28, 29, 30, 31, 32 removed.

Figure 3:
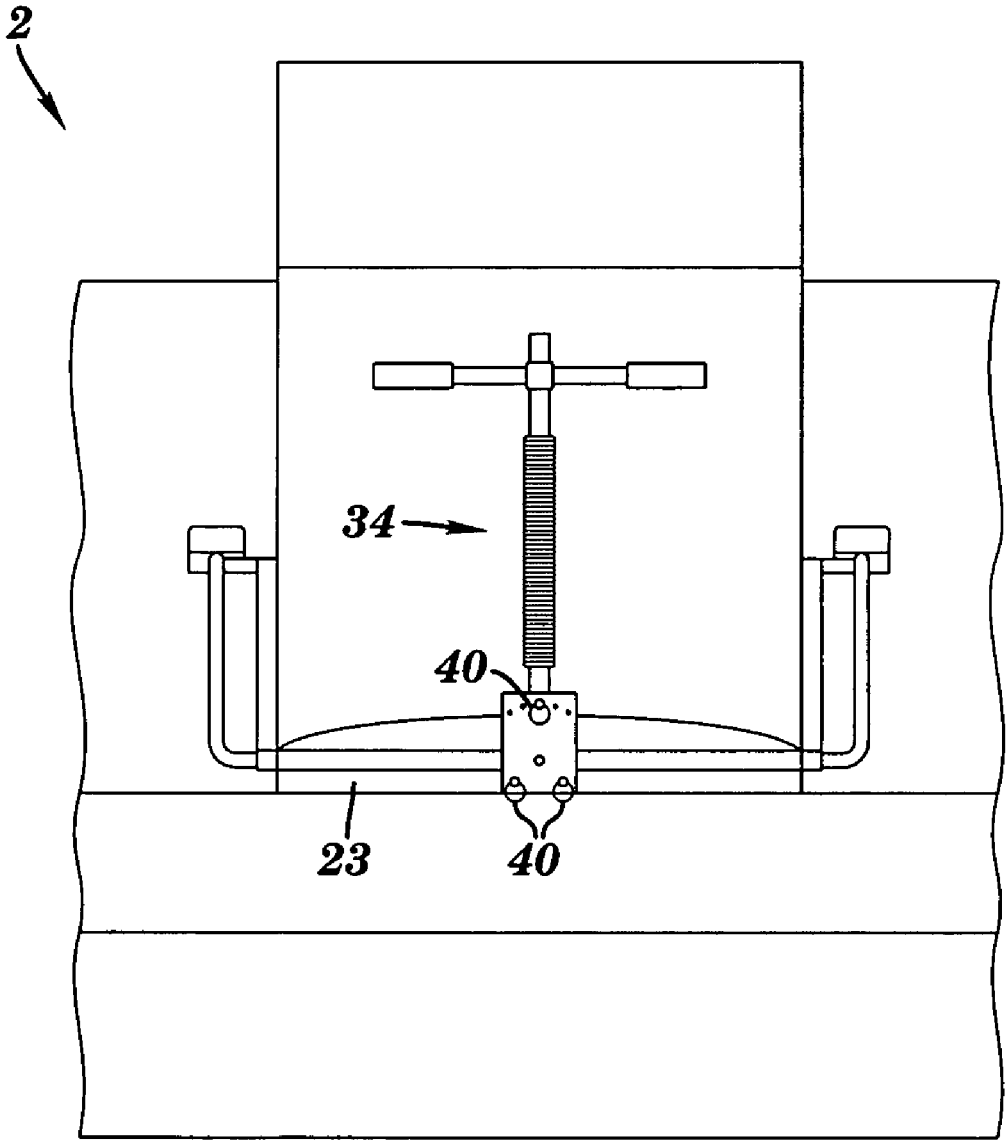
FIG. 3 illustrates a front view of an alternative embodiment for the portable exercise apparatus of FIG. 2, in accordance with embodiments of the present invention.

FIG. 3 illustrates a front view of the portable exercise apparatus 2 of FIG. 2 additionally comprising a removably attachable exercising structure 34, in accordance with embodiments of the present invention. In contrast with FIG. 2, FIG. 3 shows the portable exercise apparatus 2 with the removably attachable exercising structure 33 removed and replaced by the removably attachable exercising structure 34. The removably attachable exercising structured 34 is removably attached to the elongated member 23 using fastening devices 40.

Figure 4:
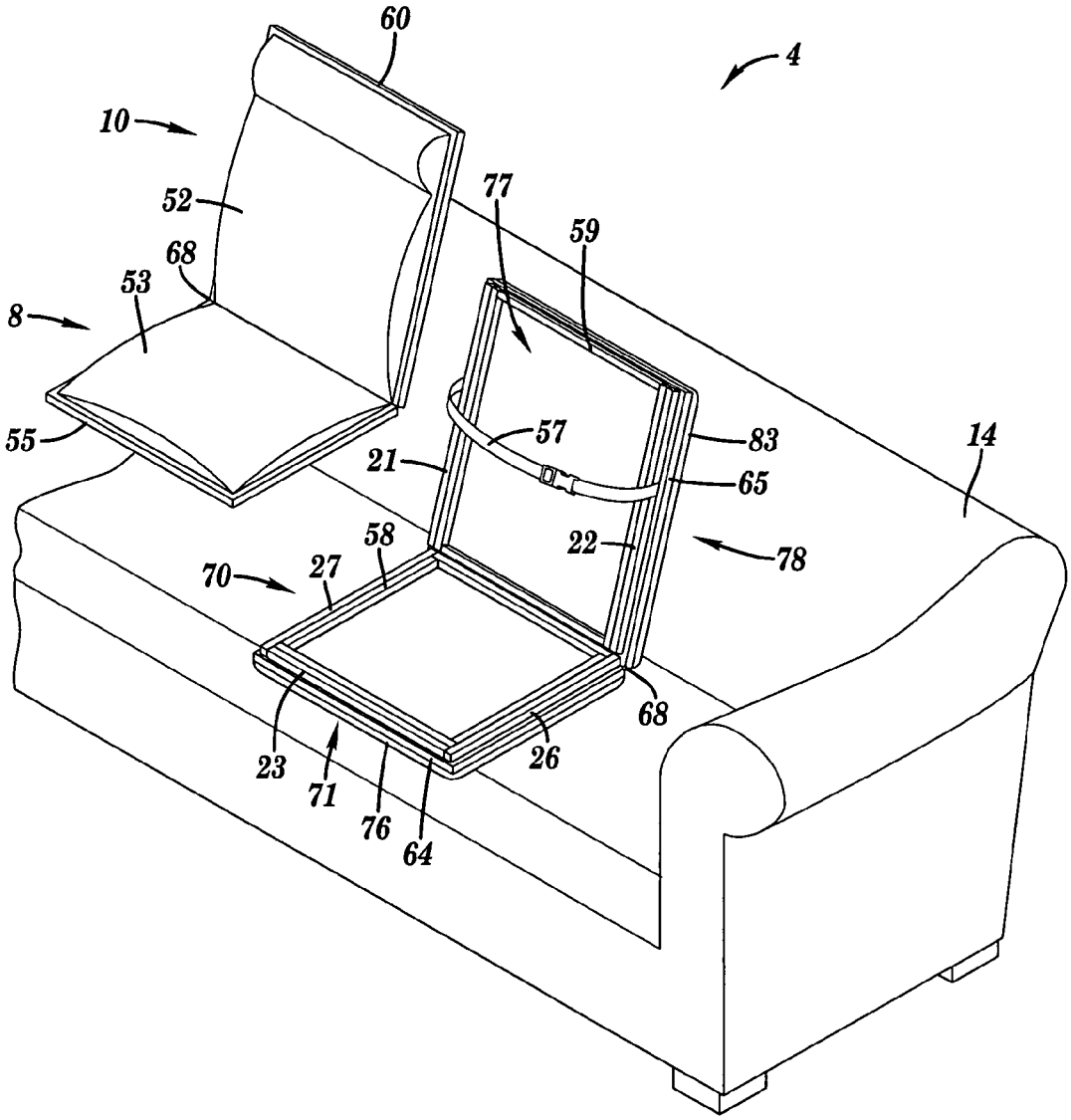
FIG. 4 illustrates an exploded view of the body support structure of FIGS. 1–3 without the removably attachable exercising structures attached, in accordance with embodiments of the present invention.

FIG. 4 illustrates an exploded view of the body support structure 4 of FIGS. 1–3 without any of the removably attachable exercising structures 19, 20, 28, 29, 30, 31, 32, 33, and 34 attached, in accordance with embodiments of the present invention. As described, infra, in the description of FIG. 1, the body support structure 4 comprises a sitting structure 8 pivotally attached to a back support structure 10. The sitting structure 8 is pivotally attached to a back support structure 10 using a pivot device 68. The pivot device 68 any pivot device known to a person of ordinary skill in the art such as, inter alia, a hinge(s), a piano hinge, etc. The sitting structure 8 comprises a substantially flat structure 55 mounted on a front side 70 of the frame 58, a substantially flat structure 64 mounted on a back side 71 of the frame 58, and the elongated members 23, 26 and 27. Each of the substantially flat structures 55 and 64 may comprise a material such as, inter alia, wood, metal, plastic, etc. The frame 58 and the elongated members 23, 26 and 27 may each comprise a material such as, inter alia, wood, metal, plastic, etc. The sitting structure 8 may additionally comprise a padding structure 53 covering the substantially flat structure 55 and a padding structure 76 covering the substantially flat structure 64. The padding structure 53 may comprise padding material covered by cover material. The padding structure 76 may comprise padding material covered by cover material. The padding material may be any padding material know to a person of ordinary skill in the art including, inter alia, foam, felt, feathers, polyester, rubber, etc. The cover material may be any cover material know to a person of ordinary skill in the art include, inter alia, fabric, rubber, plastic, vinyl, etc. The back support structure 10 comprises a substantially flat structure 60 mounted on a front side 77 of a frame 59, a substantially flat structure 65 mounted on a back side 78 of the frame 59, and the elongated members 21 and 22. Each of the substantially flat structures 60 and 65 may comprise a material such as, inter alia, wood, metal, plastic, etc. The frame 59 and the elongated members 21 and 22 may each comprise a material such as, inter alia, wood, metal, plastic, etc. The back support structure 10 may additionally comprise a padding structure 52 covering the substantially flat structure 60 and a padding structure 83 covering the substantially flat structure 65. The padding structure 52 may comprise padding material covered by a cover material. The padding structure 83 may comprise padding material covered by cover material. The padding material may comprise any padding material know to a person of ordinary skill in the art including, inter alia, foam, felt, feathers, polyester, rubber, etc. The cover material may include a material such as, inter alia, fabric, rubber, plastic, vinyl, etc.

Figure 5:
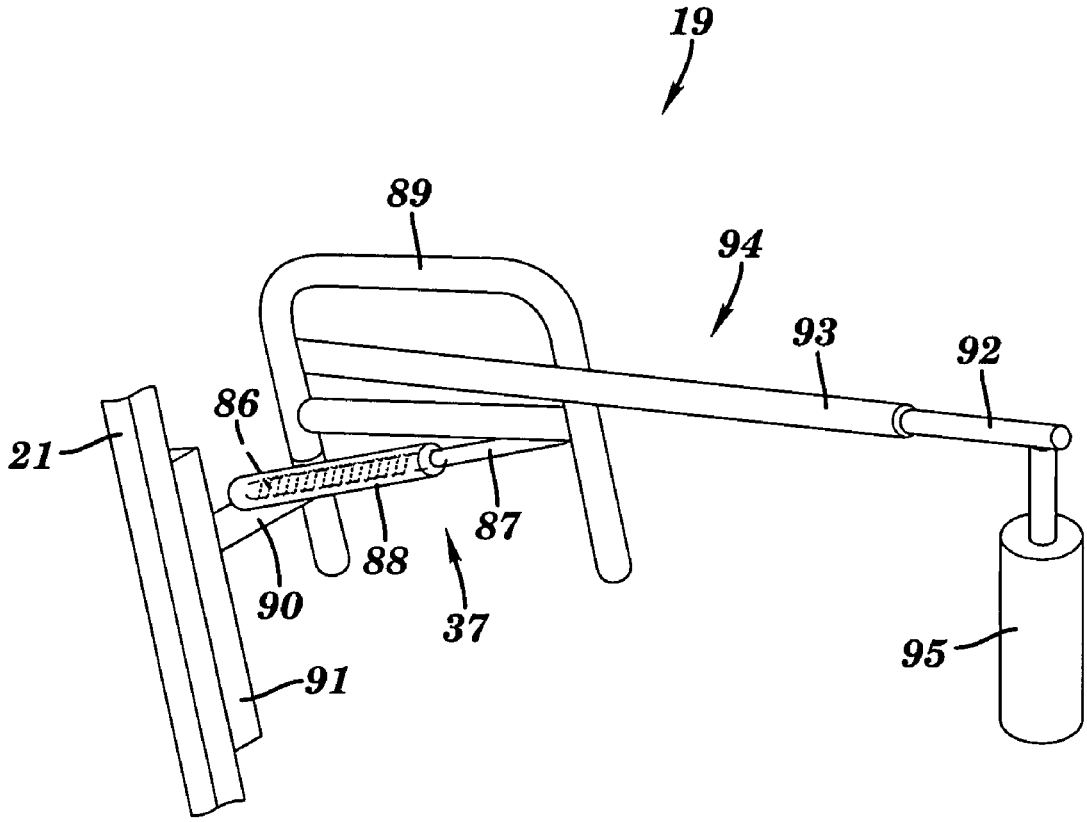
FIG. 5 illustrates a three dimensional view of the of a first removably attachable exercising structure of FIG. 1, in accordance with embodiments of the present invention.

FIG. 5 illustrates a three dimensional view of the removably attachable exercising structure 19 of FIG. 1, in accordance with embodiments of the present invention. The following description of the removably attachable exercising structure 19 also applies to the removably attachable exercising structure 20 of FIG. 1. The removably attachable exercising structure 19 comprises a resilient structure 89 rotatably attached to a resilient structure 90, a resistance means 37, and an attachment device 91. The resistance means 37 applies a preset amount of resistance against movement of the resilient structure 89 with respect to the resilient structure 90. The resistance means 37 comprises a tubular member 87 slidably attached to a tubular member 88, a spring 86 located inside the tubular member 88, and an attachment device 91. The spring 86 applies a preset amount of resistance against movement of the tubular member 87 with respect to the tubular member 88 thereby applying the preset amount of resistance against movement of the resilient structure 89 with respect to the resilient structure 90. The attachment device 91 is adapted to removably attach the removably attachable exercising structure 19 to the body support structure 4 (i.e., elongated member 22) of FIG. 1. The removably attachable exercising structure 19 may additionally comprise an adjustable extension device 94 mechanically attached to the resilient structure 89. The adjustable extension device 94 comprises a tubular member 92 adjustably and slidably attached to a tubular member 93. The tubular member 92 may additionally comprise padding 95.

Figure 6:
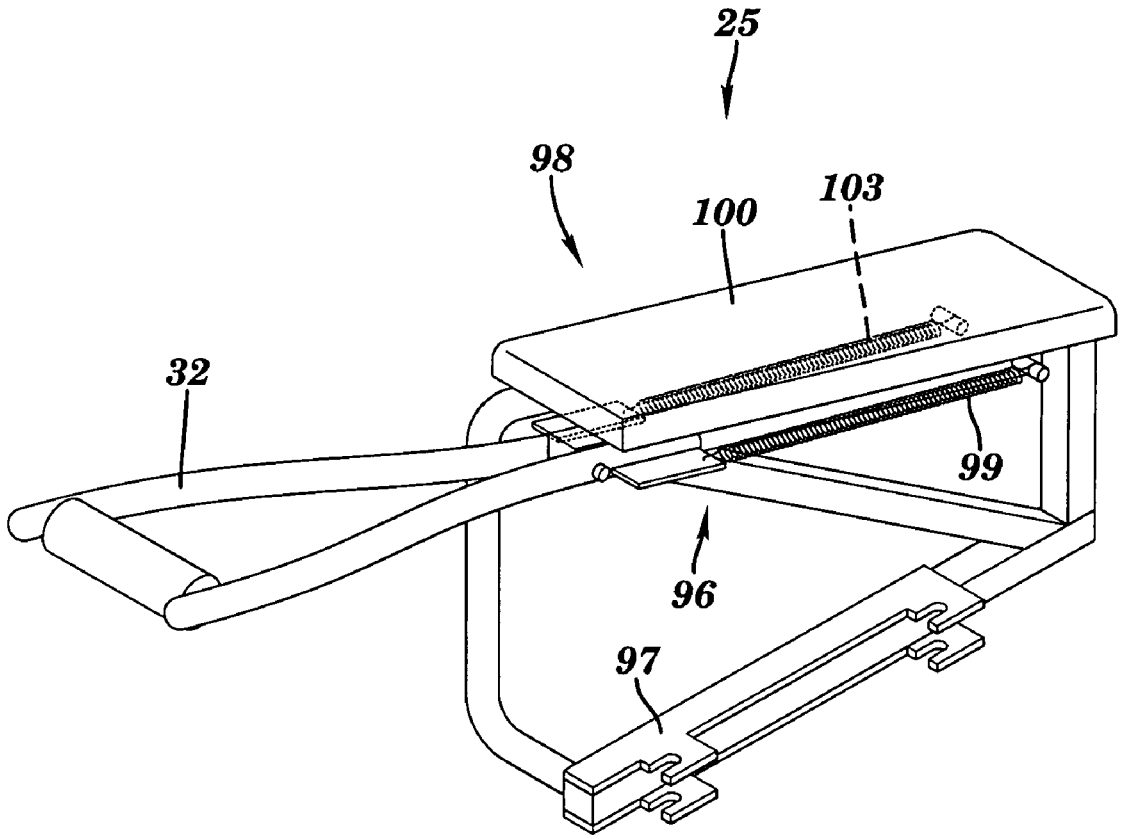
FIG. 6 illustrates a three dimensional view of the of the removably attachable armrest structure comprising a second exercising structure of FIG. 1, in accordance with embodiments of the present invention.

FIG. 6 illustrates a three dimensional view of the removably attachable armrest structure 25 comprising the exercising structure 32 of FIG. 1, in accordance with embodiments of the present invention. The following description of the removably attachable armrest structure 25 also applies to the removably attachable armrest structure 24 comprising the exercising structure 31 of FIG. 1. The armrest structure 25 is removably attached to the elongated member 26 (see FIG. 1). The armrest structure 25 comprises the exercising structure 32, a resistance means 96, an armrest 98, and an attachment device 97. The exercising structure 32 is pivotally attached to the armrest 98. The resistance means 96 applies a preset amount of resistance against movement of the exercising structure 32 with respect to the armrest 98. The resistance means 37 comprises springs 103 and 99. The resistance means 37 may alternatively comprise, inter alia, one spring, a plurality of springs, a resistance band, a pneumatic resistance device, a hydraulic resistance device, etc. The attachment device 97 is adapted to removably attach the armrest structure 25 to the body support structure 4 (e.g., elongated member 26) of FIG. 1. The armrest 98 may additionally comprise padding 100.

Figure 7:
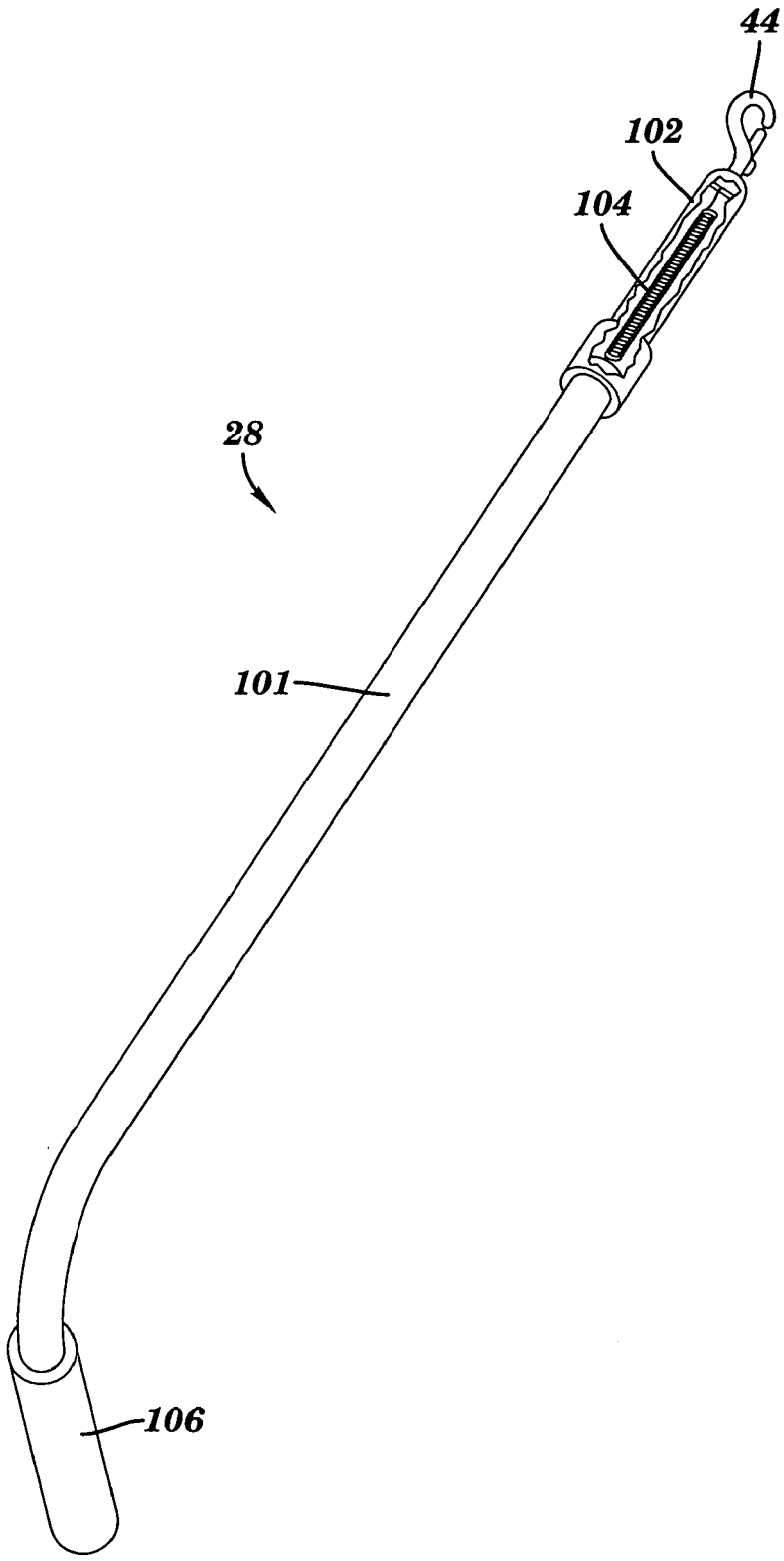
FIG. 7 illustrates a three dimensional view of the of a third removably attachable exercising structure of FIG. 1, in accordance with embodiments of the present invention.

FIG. 7 illustrates a three dimensional view of the removably attachable exercising structure 28 of FIG. 1, in accordance with embodiments of the present invention. The following description of the removably attachable exercising structure 28 also applies to the removably attachable exercising structure 29 of FIG. 1. The removably attachable exercising structure 28 comprises a tubular member 101 slidably attached to a tubular member 102, a resistance means 104, and a latching device 44. The resistance means 104 applies a preset amount of resistance against movement of the tubular member 101 with respect to the tubular member 102. The resistance means 104 comprises a spring. The resistance means 104 may alternatively comprise any resistance means known to a person of ordinary skill in the art including, inter alia, an elastic band(s), a resistance band, a pneumatic resistance device, a hydraulic resistance device, a pneumatic resistance device, a hydraulic resistance device, etc. The latching device 44 is adapted to removably attach the removably attachable exercising structure 28 to the body support structure 4 (i.e., any of the plurality of hooking devices 42 on each of the elongated members 21, 22, 26, and 27 and the frame structure 35) of FIG. 1. The latching device 44 may be any latching device known to a person of ordinary skill in the art such as, inter alia, a bolt snap, a trigger snap, a spring snap, a breeching snap, a carabineer, etc. The tubular member 101 may additionally comprise padding 106.

Figure 8:
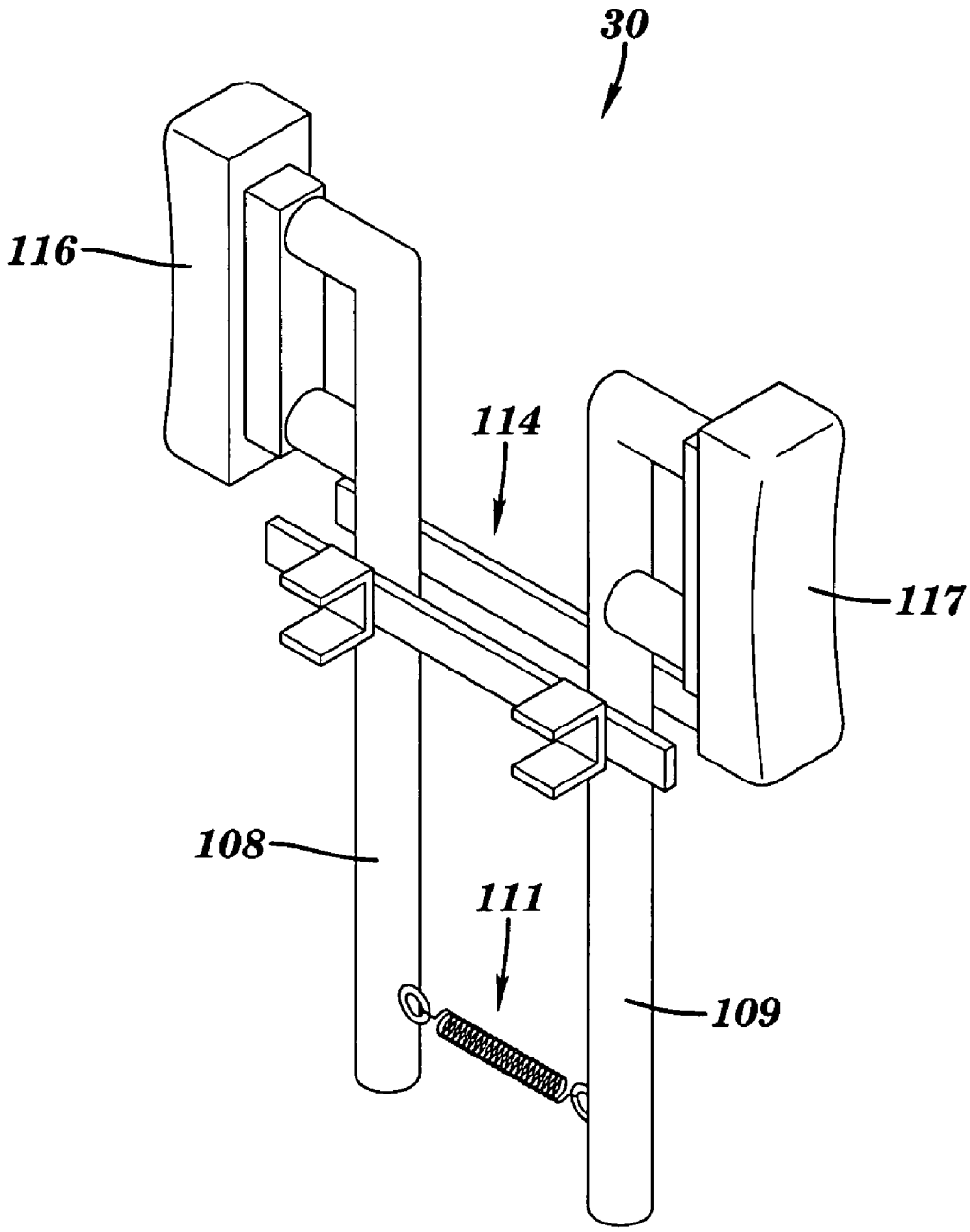
FIG. 8 illustrates a three dimensional view of the of a fourth removably attachable exercising structure of FIG. 1, in accordance with embodiments of the present invention.

FIG. 8 illustrates a three dimensional view of the removably attachable exercising structure 30 of FIG. 1, in accordance with embodiments of the present invention. The removably attachable exercising structure 30 comprises a tubular member 108 and a tubular member 109 each pivotally attached to an attachment structure 114 and a resistance means 111. The resistance means 111 applies a preset amount of resistance against movement of the tubular member 108 and the tubular member 109 with respect to each other. The resistance means 111 comprises a spring. The resistance means 111 may alternatively comprise any resistance means known to a person of ordinary skill in the art including, inter alia, an elastic band(s), a resistance band, a pneumatic resistance device, a hydraulic resistance device, etc. The attachment structure 114 is adapted to removably attach the removably attachable exercising structure 30 to the body support structure 4 (e.g., elongated member 23) of FIG. 1. The tubular member 108 may additionally comprise padding 116. The tubular member 109 may additionally comprise padding 117.

Figure 9:
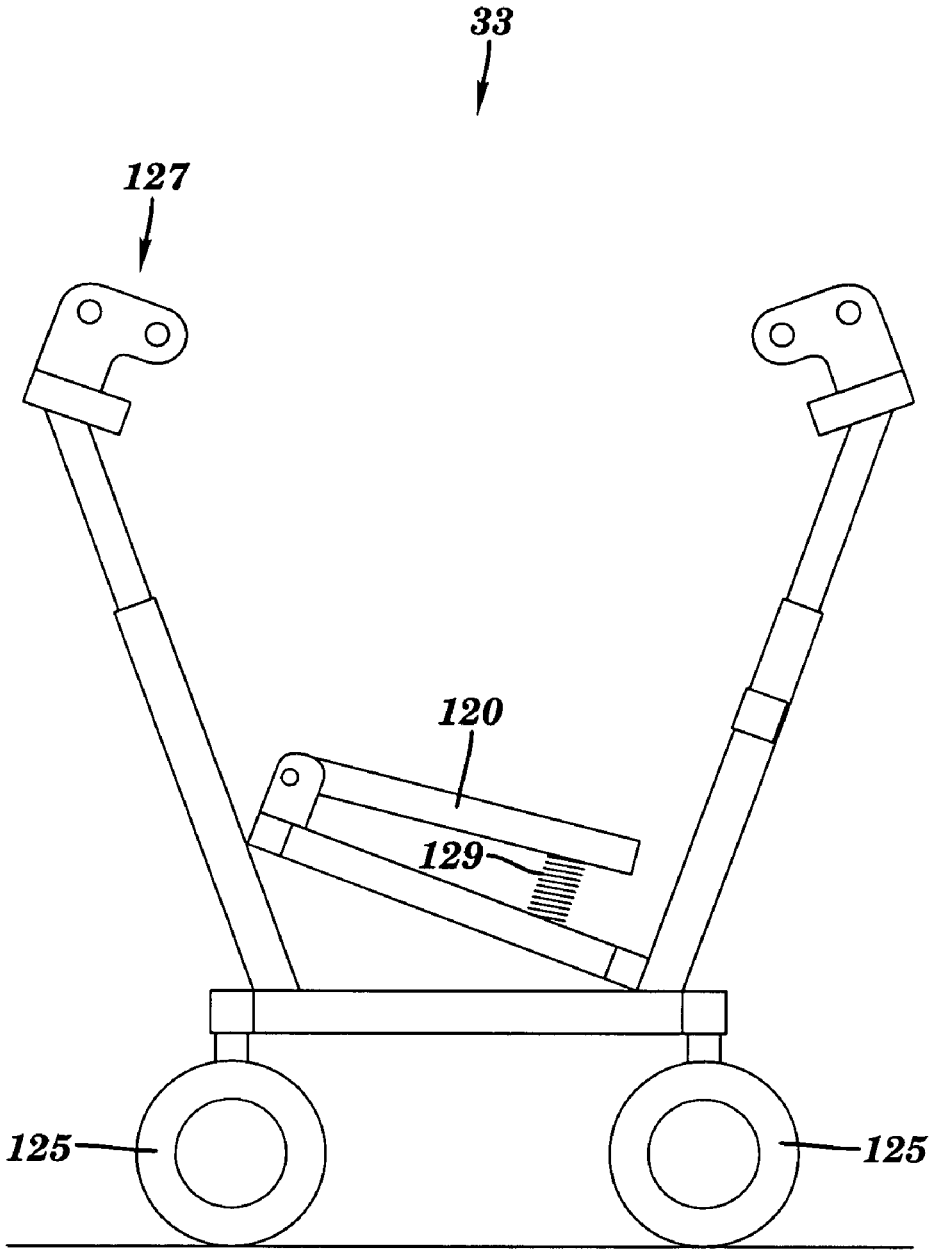
FIG. 9 illustrates a side view of a fifth removably attachable exercising structure of FIG. 1, in accordance with embodiments of the present invention.

FIG. 9 illustrates a side view of the of the removably attachable exercising structure 33 of FIG. 2, in accordance with embodiments of the present invention. The removably attachable exercising structure 33 comprises a structure 120 pivotally attached to an attachment structure 127 and a resistance means 129. The resistance means 129 applies a preset amount of resistance against movement of the structure 120. The resistance means 129 comprises a spring. The resistance means 129 may alternatively comprise any resistance means known to a person of ordinary skill in the art including, inter alia, an elastic band(s), a resistance band, a pneumatic resistance device, a hydraulic resistance device, etc. The removably attachable exercising structure 33 may additionally comprise a second structure and second resistance means equivalent to the structure 120 and the resistance means 129. The attachment structure 127 is adapted to removably attach the removably attachable exercising structure 33 to the body support structure 4 (e.g., elongated member 23) of FIG. 2. The removably attachable exercising structure 33 may additionally comprise wheels 125.

Figure 10:
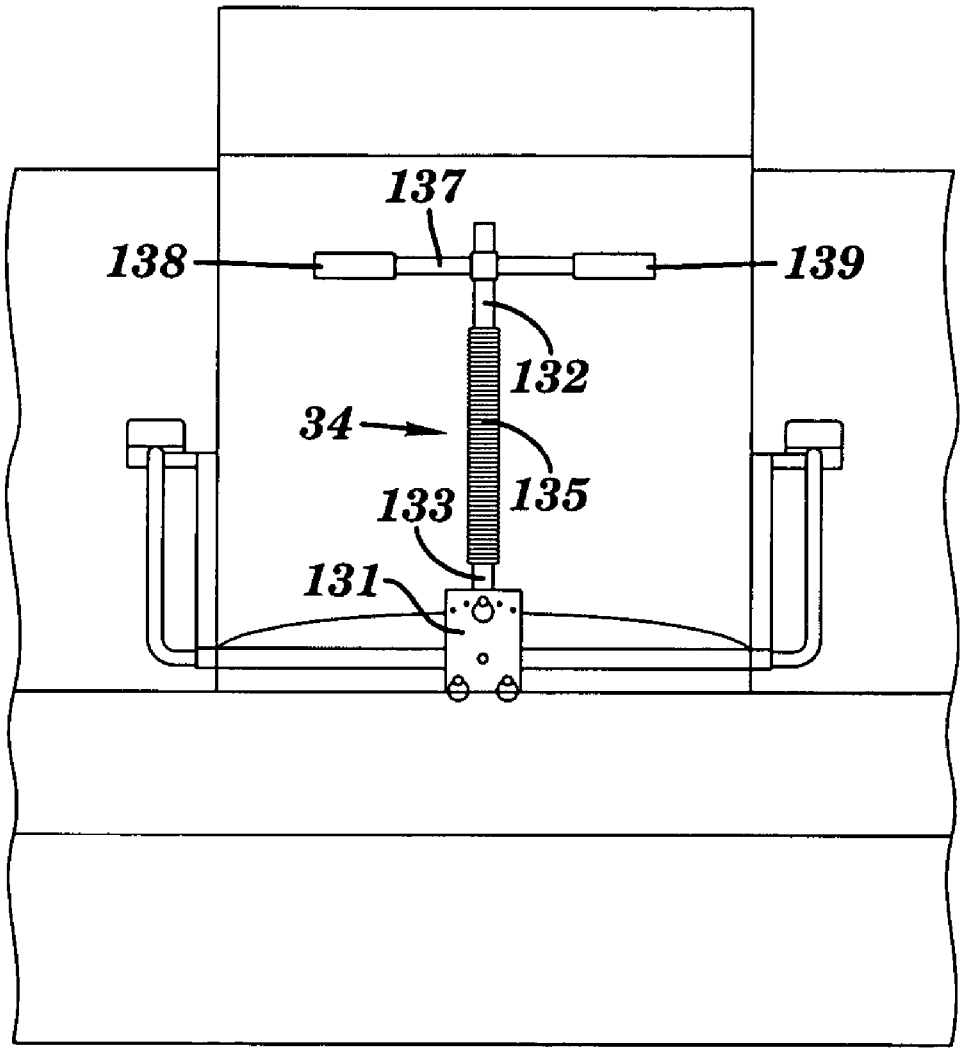
FIG. 10 illustrates a front view of the of a sixth removably attachable exercising structure of FIG. 1, in accordance with embodiments of the present invention.

FIG. 10 illustrates a front view of the of the removably attachable exercising structure 34 of FIG. 3, in accordance with embodiments of the present invention. The removably attachable exercising structure 34 a spring 135 pivotally attaching a tubular structure 132 to a tubular structure 133, a tubular structure 137 perpendicularly attached to the tubular structure 132, and an attachment structure 131. The spring 135 is adapted to apply a preset amount of resistance against movement of the tubular structure 132 with respect to the tubular structure 133. The attachment structure 131 is adapted to removably attach the removably attachable exercising structure 34 to the body support structure 4 (e.g., elongated member 23) of FIG. 3. The tubular structure 137 may additionally comprise padding 138 and 139. Alternatively, tubular structure 137 may be removed from the tubular structure 132 for one handed exercising (see FIG. 15).

FIGS. 11–22 illustrate the portable exercise apparatus 2 of FIGS. 1–3 in use showing examples of a person 145 using the exercising structures 19, 20, 28, 29, 30, 31, and 32, 33, 34, and 43 of FIGS. 1–10 to exercise, in accordance with embodiments of the present invention. FIGS. 11–17 show the body support structure 4 placed on a sitting means 14. FIGS. 18–22 show the body support structure 4 placed on a ground surface. Note that the examples shown in FIGS. 11–22 are for illustration purposes and that various other exercises may be accomplished using the portable exercise apparatus 2 with the exercising structures 19, 20, 28, 29, 30, 31, and 32, 33, 34, and 43.

Figure 11:
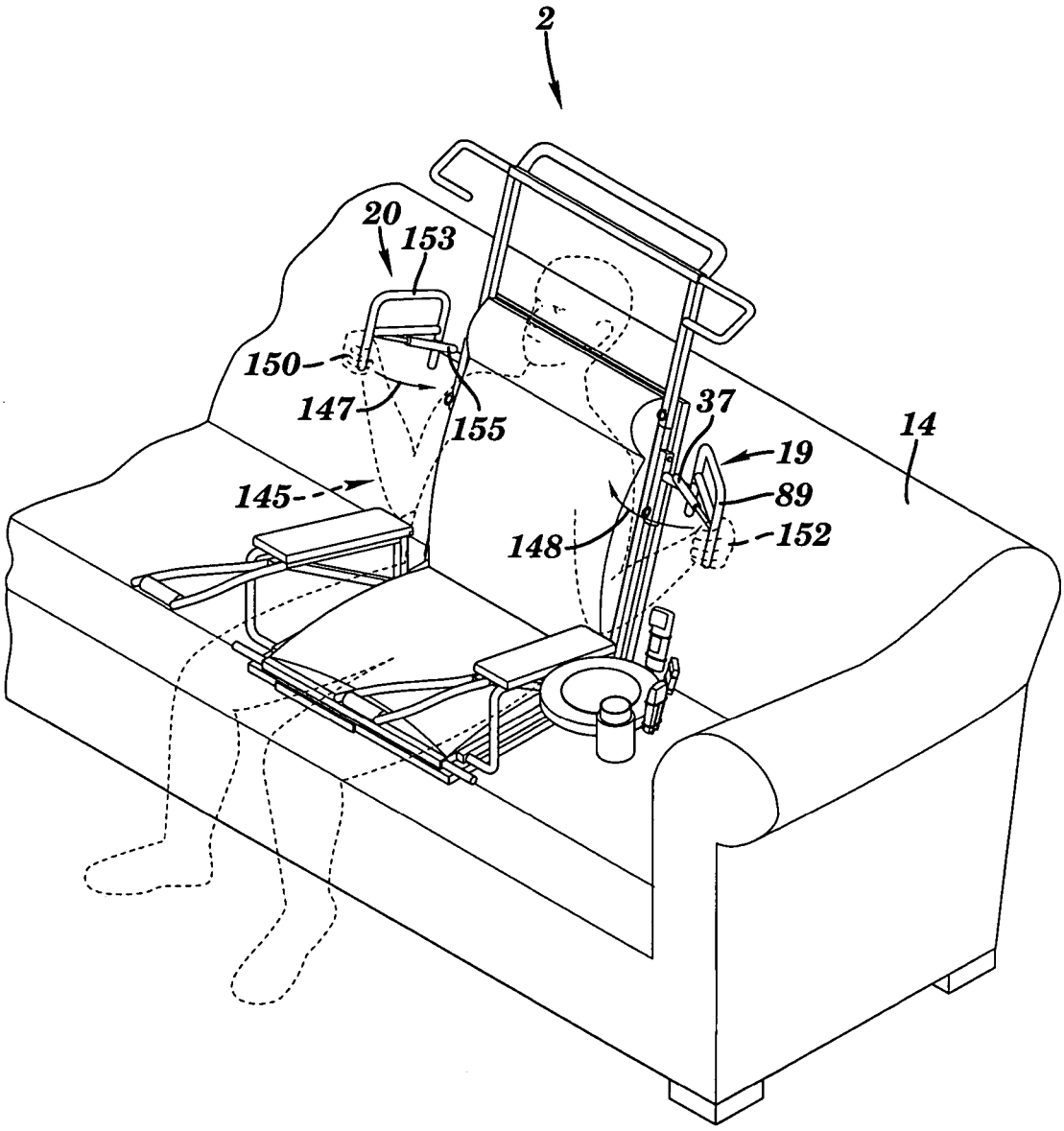
FIG. 11 illustrates a person in a sitting position using the removably attachable exercising structures and of FIGS. 1 and 5 to exercise, in accordance with embodiments of the present invention.

FIG. 11 illustrates a person 145 in a sitting position using the exercising structures 19 and 20 of FIGS. 1 and 5 to exercise, in accordance with embodiments of the present invention. The person 145 is shown using a hand 152 to secure and move the resilient structure 89 in a direction 148 against the preset amount of resistance supplied by the resistance means 37. Concurrently, the person 145 is shown using a hand 150 to secure and move the resilient structure 153 in a direction 147 against the preset amount of resistance supplied by the resistance means 155. The exercise shown in FIG. 11 may be used to strengthen, inter alia, arm muscles, chest muscles, back muscles, etc.

Figure 12:
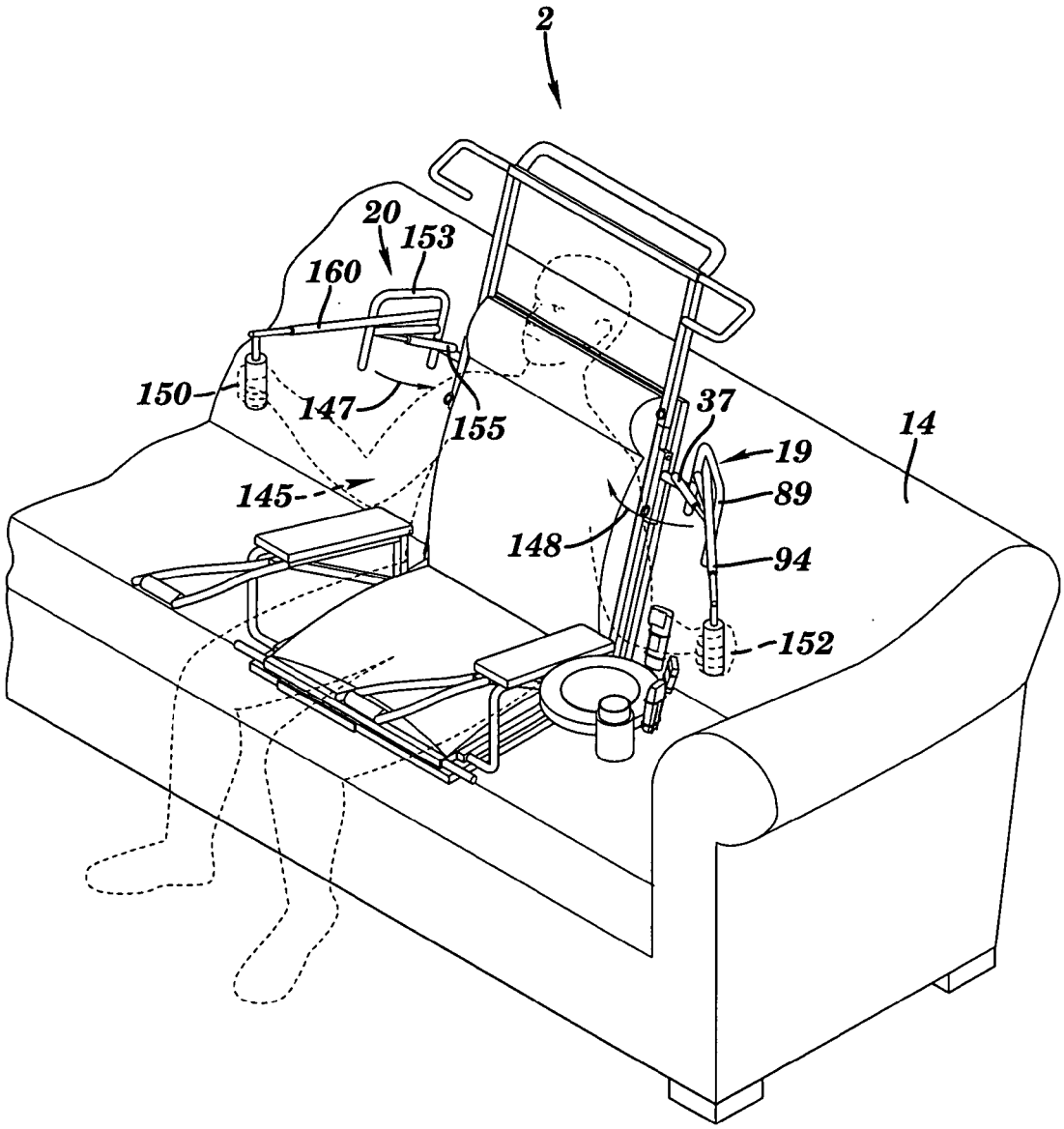
FIG. 12 illustrates a modified use for FIG. 11, in accordance with embodiments of the present invention.

FIG. 12 illustrates a modified use of FIG. 11 showing the person 145 in a sitting position using the exercising structures 19 and 20 of FIGS. 1 and 5 to exercise, in accordance with embodiments of the present invention. The person 145 is shown using the hand 152 to secure the adjustable extension device 94 to move the resilient structure 89 in the direction 148 against the preset amount of resistance supplied by the resistance means 37. Concurrently, the person 145 is shown using a hand 150 to secure the adjustable extension device 160 to move the resilient structure 153 in the direction 147 against the preset amount of resistance supplied by the resistance means 155. The exercise shown in FIG. 12 may be used to strengthen, inter alia, arm muscles, chest muscles, back muscles, etc.

Figure 13:
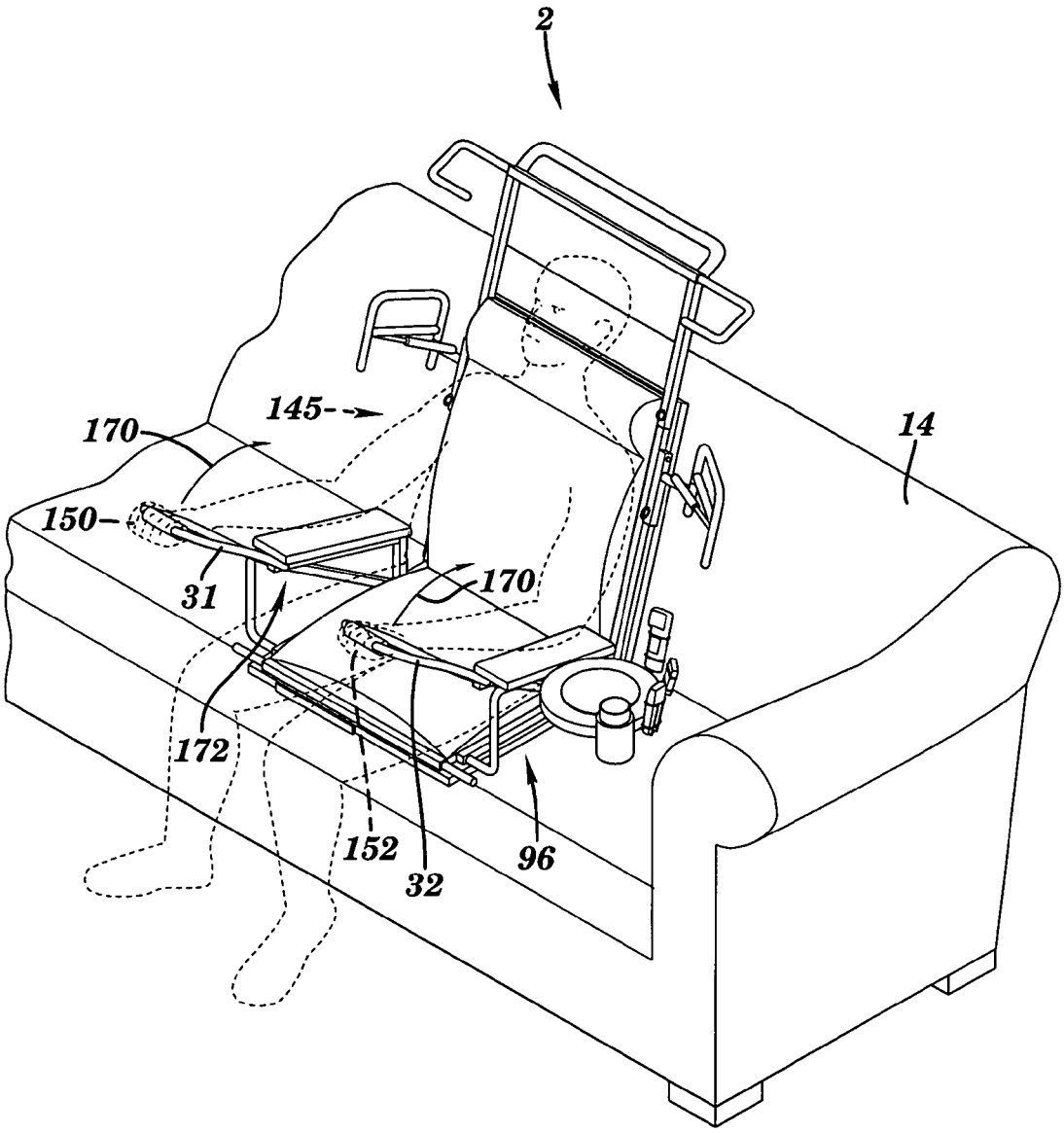
FIG. 13 illustrates a person in a sitting position using the exercising structures of FIGS. 1 and 6 to exercise, in accordance with embodiments of the present invention.

FIG. 13 illustrates a person 145 in a sitting position using the exercising structures 31 and 32 of FIGS. 1 and 6 to exercise, in accordance with embodiments of the present invention. The person 145 is shown using a hand 152 to secure and move the resilient structure 32 in a direction 170 against the preset amount of resistance supplied by the resistance means 96. Concurrently, the person 145 is shown using a hand 150 to secure and move the resilient structure 31 in the direction 170 against the preset amount of resistance supplied by the resistance means 172. The exercise shown in FIG. 13 may be used to strengthen, inter alia, arm muscles, etc.

Figure 14:
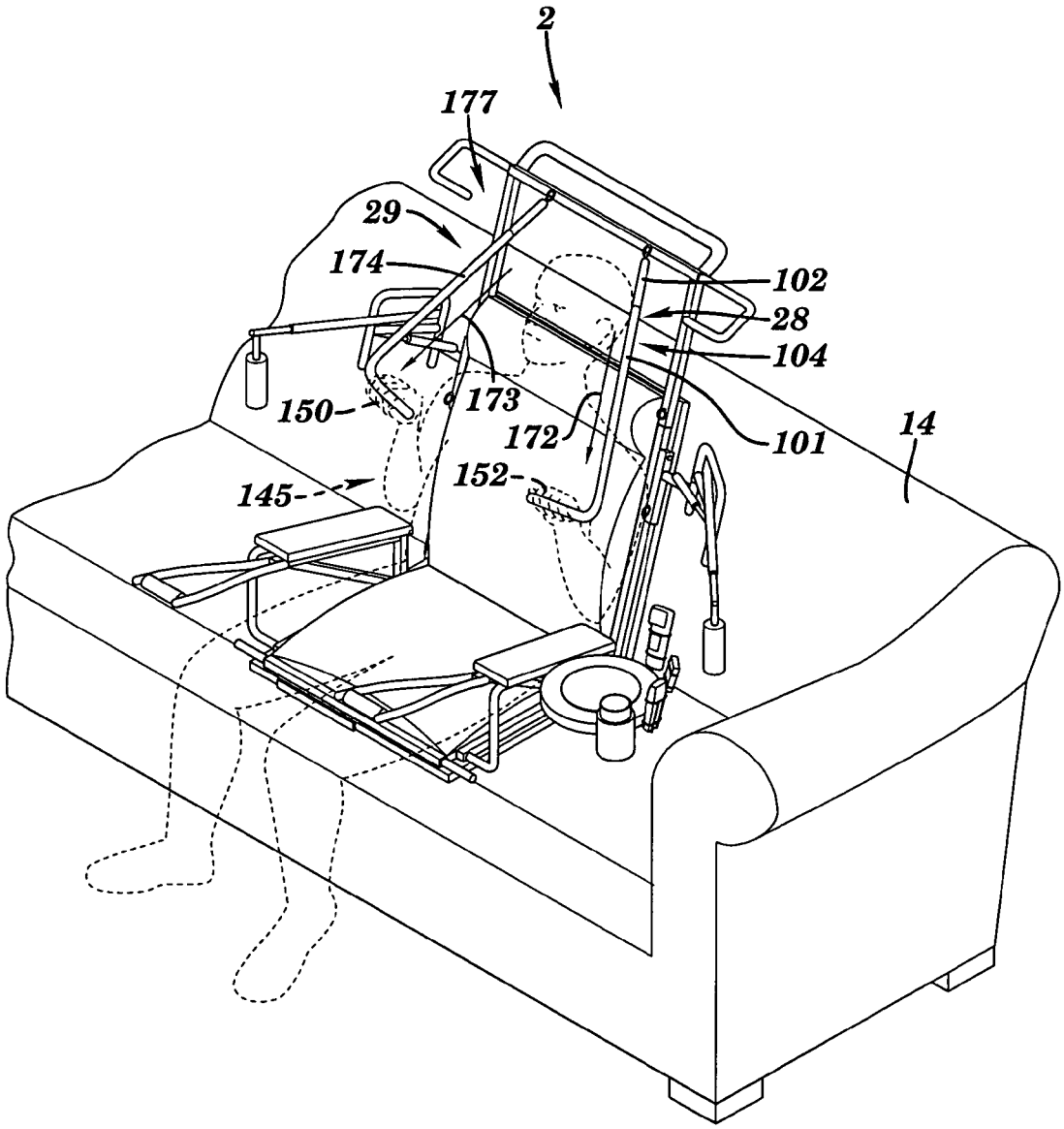
FIG. 14 illustrates a person in a sitting position using the exercising structures of FIGS. 1 and 7 to exercise, in accordance with embodiments of the present invention.

FIG. 14 illustrates a person 145 in a sitting position using the exercising structures 28 and 29 of FIGS. 1 and 7 to exercise, in accordance with embodiments of the present invention. The person 145 is shown using a hand 152 to secure and move the resilient structure 101 in a direction 172 against the preset amount of resistance supplied by the resistance means 104. Concurrently, the person 145 is shown using a hand 150 to secure and move the resilient structure 174 in a direction 173. against the preset amount of resistance supplied by the resistance means 177. The exercise shown in FIG. 14 may be used to strengthen, inter alia, arm muscles, chest muscles, back muscles, shoulder muscles, etc.

Figure 15:
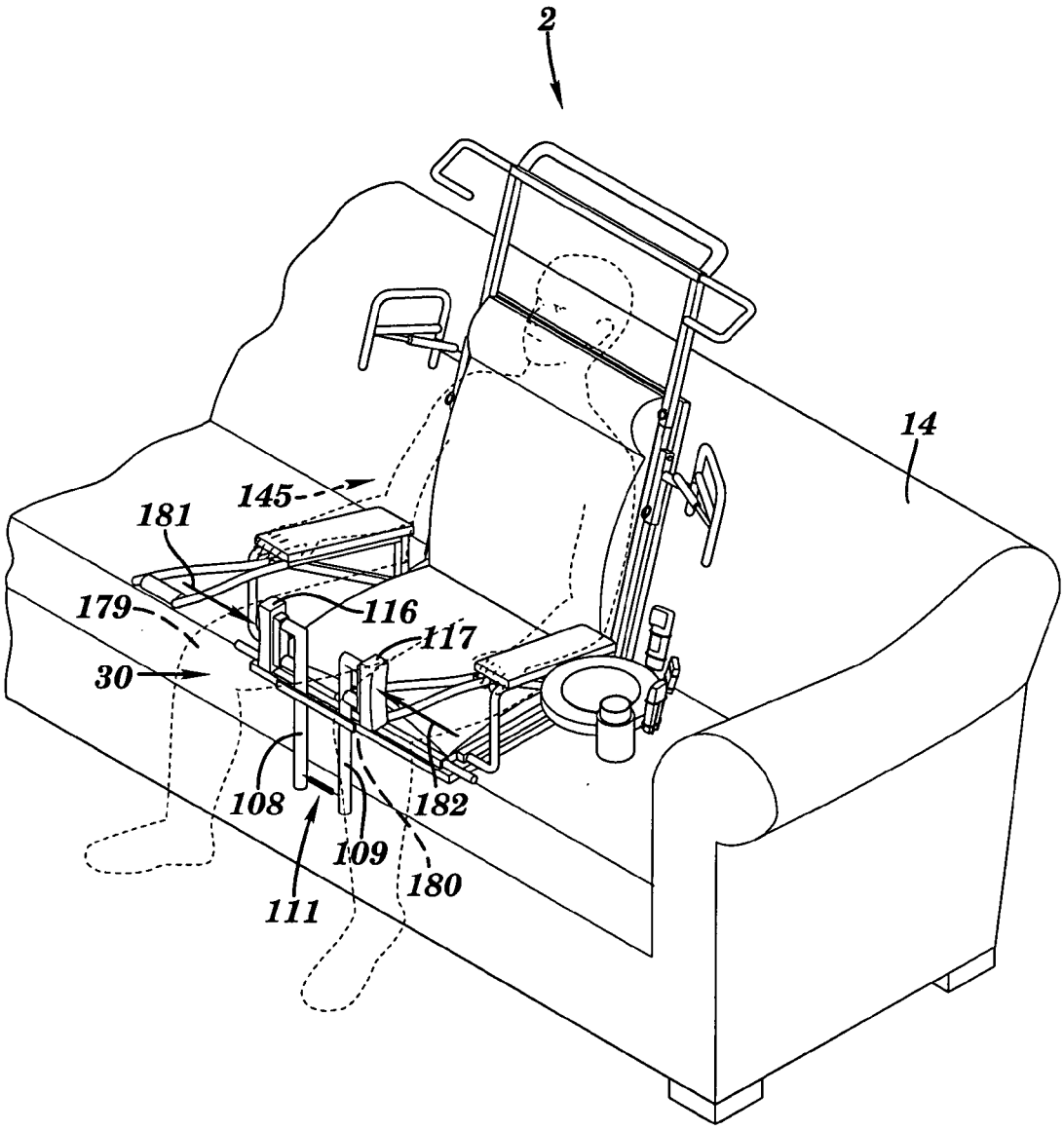
FIG. 15 illustrates a person in a sitting position using the exercising structure of FIGS. 1 and 8 to exercise, in accordance with embodiments of the present invention.

FIG. 15 illustrates a person 145 in a sitting position using the exercising structure 30 of FIGS. 1 and 8 to exercise, in accordance with embodiments of the present invention. The person 145 is shown using a leg 179 to move the tubular member 108 in a direction 181 against the preset amount of resistance supplied by the resistance means 111. Concurrently, the person 145 is shown using a leg 180 to move the tubular member 109 in a direction 182 against the preset amount of resistance supplied by the resistance means 111. The exercise shown in FIG. 15 may be used to strengthen, inter alia, leg muscles, etc.

Figure 16:
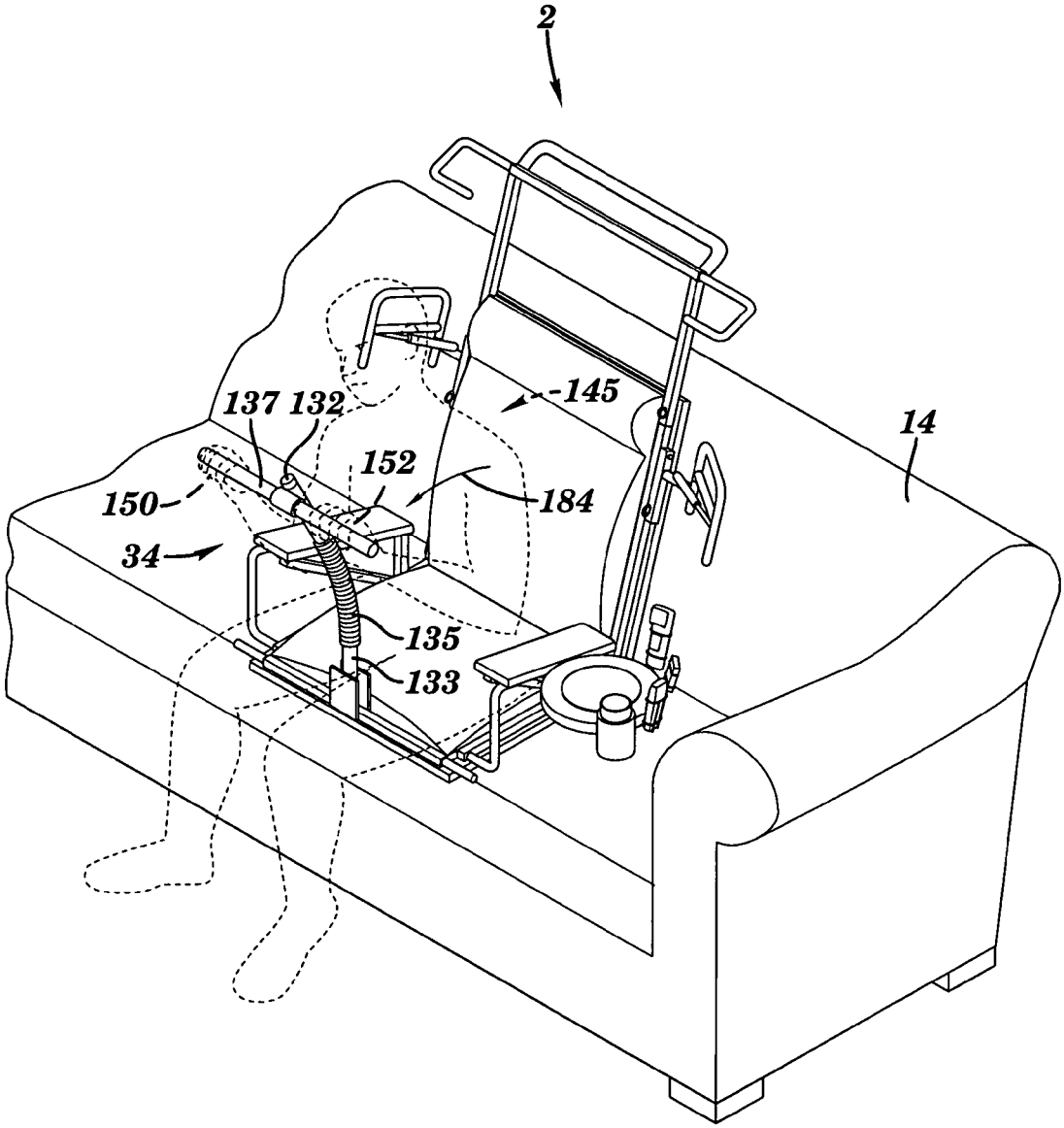
FIG. 16 illustrates a person in a sitting position using the exercising structure of FIGS. 1 and 10 to exercise, in accordance with embodiments of the present invention.

FIG. 16 illustrates a person 145 in a sitting position using the exercising structure 34 of FIGS. 1 and 10 to exercise, in accordance with embodiments of the present invention. The person 145 is shown using a hand 152 and a hand 150 to secure the tubular structure 137 to move the tubular structure 132 in a direction 184 against the preset amount of resistance supplied by the resistance means 135. Note that the tubular structure 132 may be moved in any direction with respect to the tubular structure 133. The exercise shown in FIG. 16 may be used to strengthen, inter alia, arm muscles, chest muscles, back muscles, shoulder muscles, etc.

Figure 17:
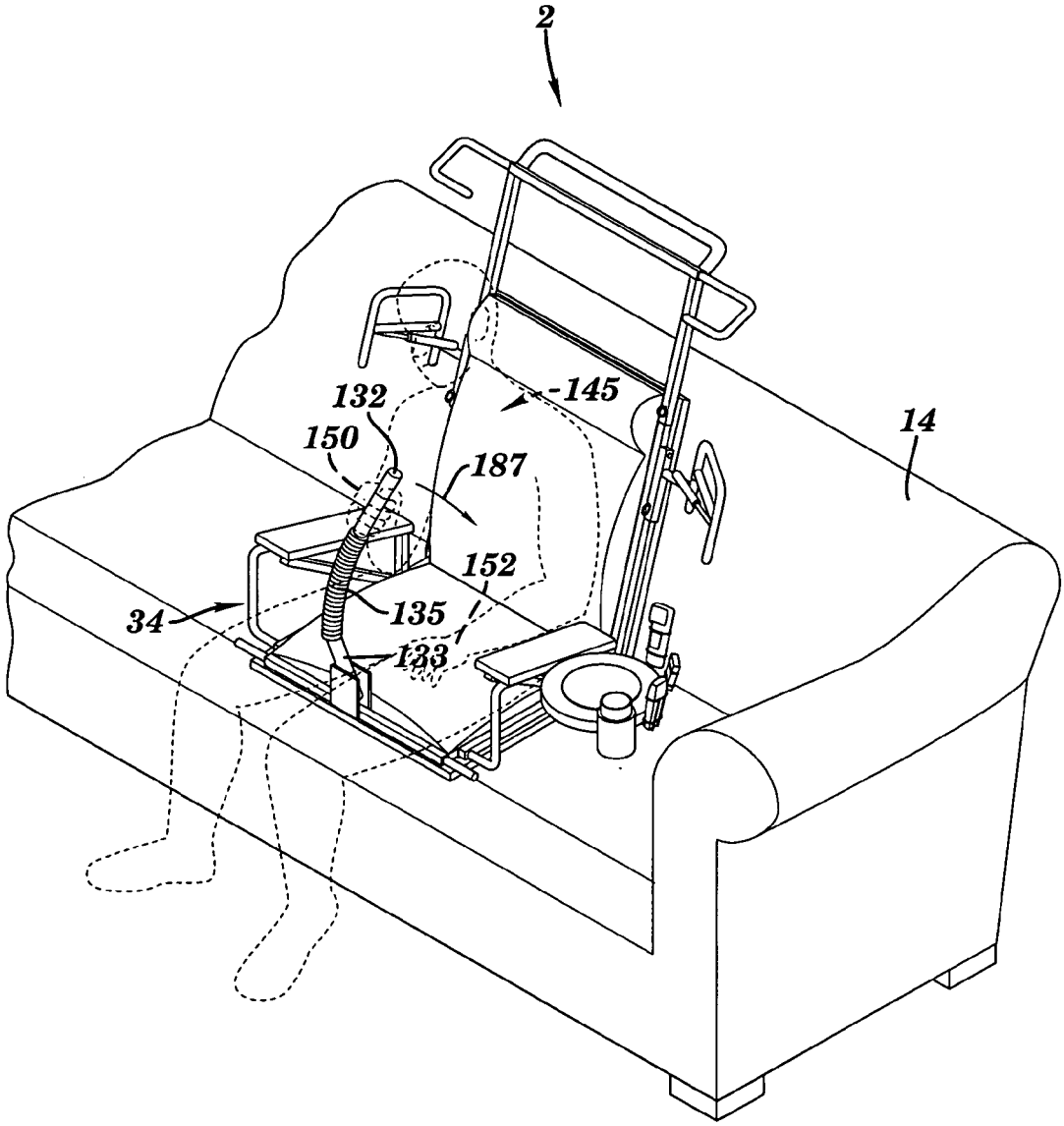
FIG. 17 illustrates a modified use for FIG. 16, in accordance with embodiments of the present invention.

FIG. 17 illustrates a modified use of FIG. 16 showing the person 145 in a sitting position using the exercising structure 34 to exercise, in accordance with embodiments of the present invention. In contrast to FIG. 16, the tubular structure 137 has been removed. The person 145 is shown using the hand 150 to secure and move the tubular structure 132 in a direction 187 against the preset amount of resistance supplied by the resistance means 135. Alternatively, the person 145 may use the hand 152 to secure and move the tubular structure 132 against the preset amount of resistance supplied by the resistance means 135. Note that the tubular structure 132 may be moved in any direction with respect to the tubular structure 133. The exercise shown in FIG. 17 may be used to strengthen, inter alia, arm muscles, chest muscles, back muscles, shoulder muscles, etc.

Figure 18:
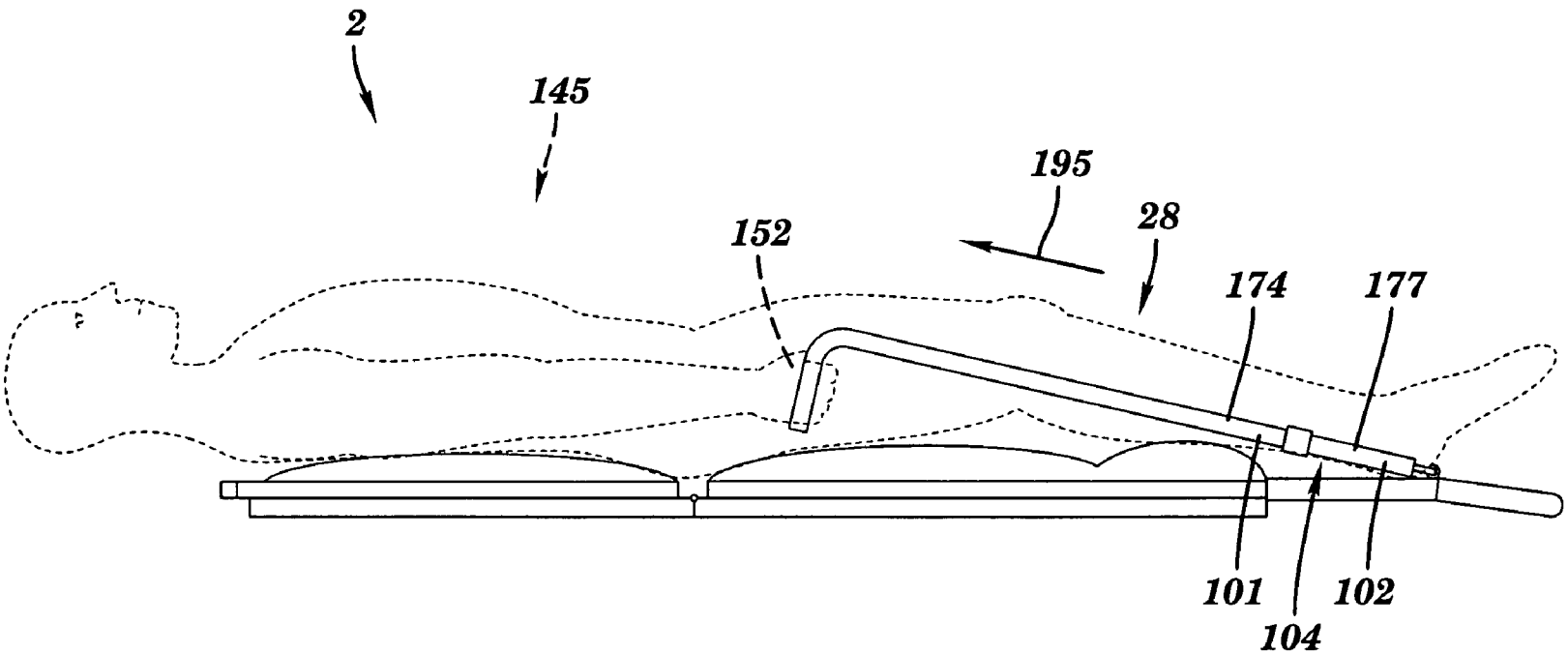
FIG. 18 illustrates a person in a lie down position using the exercising structures of FIGS. 1 and 7 to exercise, in accordance with embodiments of the present invention.

FIG. 18 illustrates a person 145 in a lie down position using the exercising structure 28 of FIGS. 1 and 7 to exercise, in accordance with embodiments of the present invention. The following description of exercising with the removably attachable exercising structure 28 also applies to exercising with the removably attachable exercising structure 29 of FIG. 1 (exercising simultaneously with a second hand (e.g., hand 150)). The person 145 is shown using a hand 152 to secure and move the resilient structure 101 in a direction 195 against the preset amount of resistance supplied by the resistance means 104. The exercise shown in FIG. 18 may be used to strengthen, inter alia, arm muscles, chest muscles, back muscles, shoulder muscles, etc.

Figure 19:
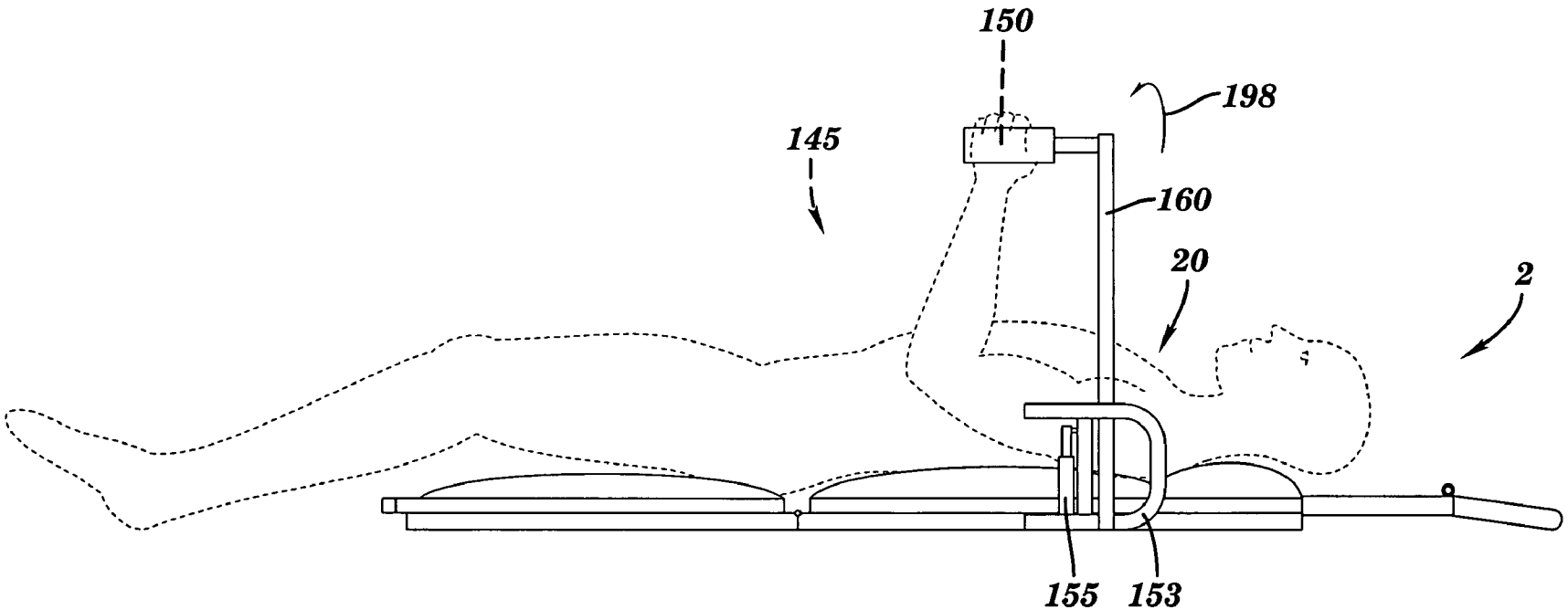
FIG. 19 illustrates a modified use of FIG. 11, in accordance with embodiments of the present invention.

FIG. 19 illustrates a modified use of FIG. 11 showing a person 145 in a lie down position using the exercising structure 20 of FIGS. 1 and 5 to exercise, in accordance with embodiments of the present invention. The following description of exercising with the removably attachable exercising structure 20 also applies to exercising with the removably attachable exercising structure 19 of FIG. 1 (exercising simultaneously and in an opposite direction (i.e., opposite to direction 198) with a second hand (e.g., hand 150)). The person 145 is shown using the hand 152 to secure the adjustable extension device 94 to move the resilient structure 89 in the direction 198 against the preset amount of resistance supplied by the resistance means 37. The exercise shown in FIG. 19 may be used to strengthen, inter alia, arm muscles, chest muscles, back muscles, etc.

Figure 20:
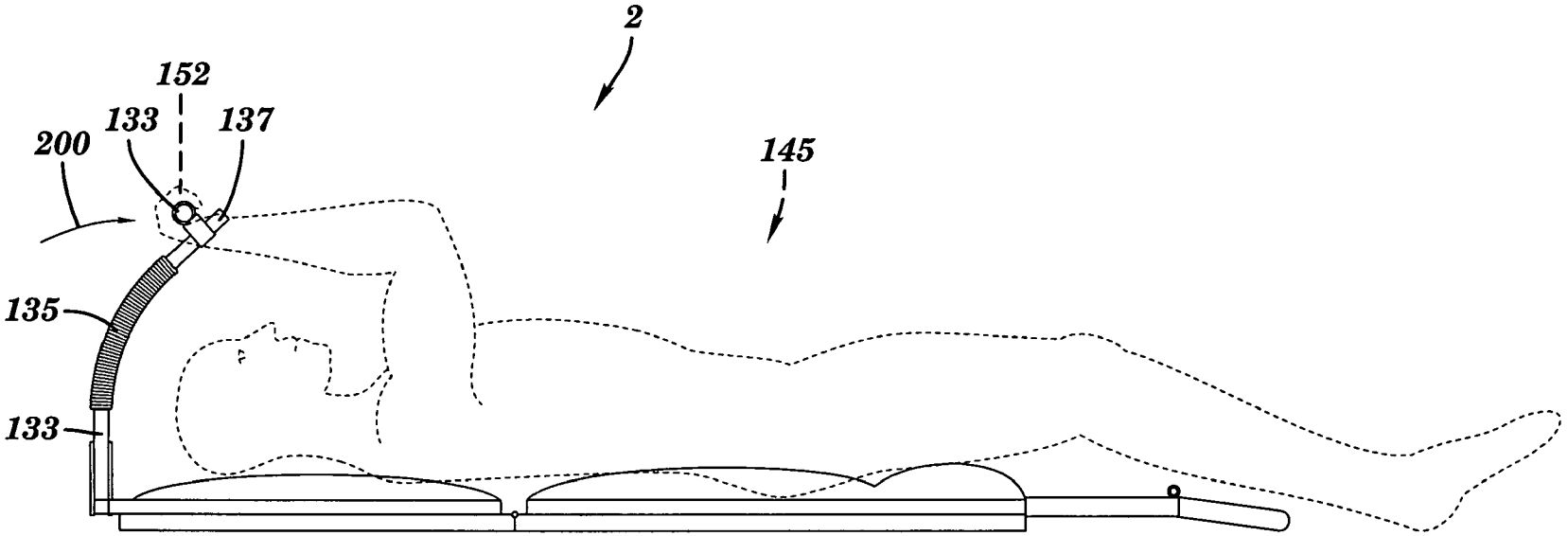
FIG. 20 illustrates a person in a lie down position using the exercising structure of FIGS. 1 and 10 to exercise, in accordance with embodiments of the present invention.

FIG. 20 illustrates a person 145 in a lie down position using the exercising structure 34 of FIGS. 1 and 10 to exercise, in accordance with embodiments of the present invention. The person 145 is shown using a hand 152 (hand 150 may simultaneously be used) to secure the tubular structure 137 to move the tubular structure 132 in a direction 184 against the preset amount of resistance supplied by the resistance means 135. Note that the tubular structure 132 may be moved in any direction with respect to the tubular structure 133. The exercise shown in FIG. 16 may be used to strengthen, inter alia, arm muscles, chest muscles, back muscles, shoulder muscles, etc.

Figure 21:
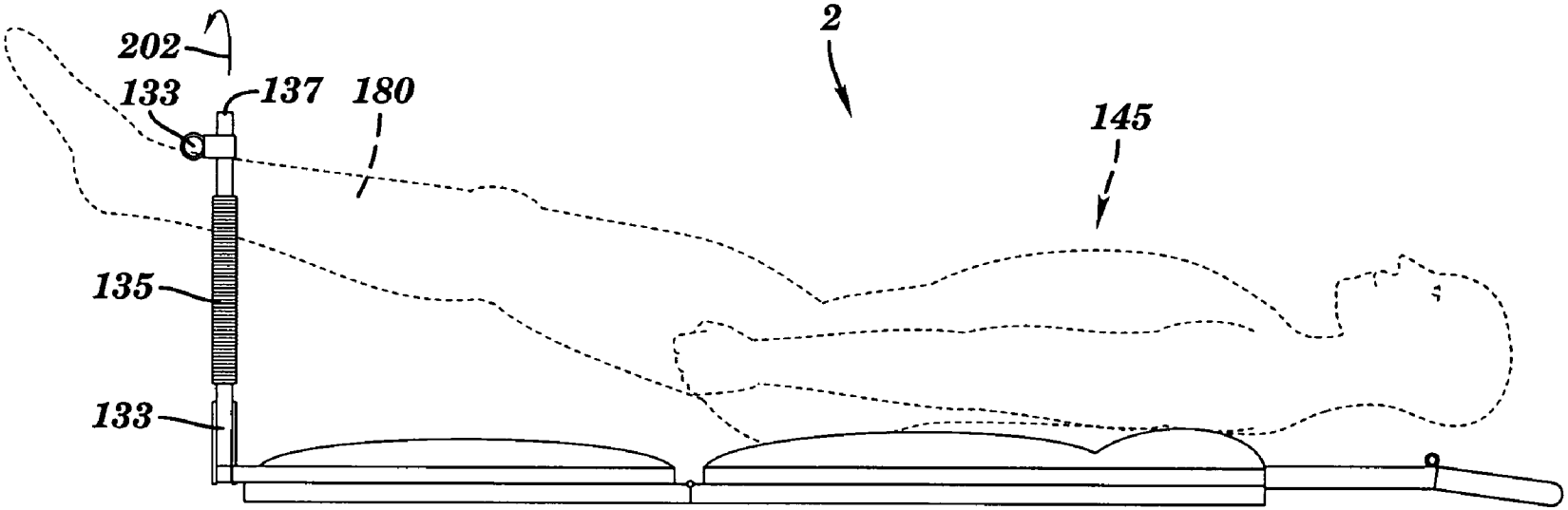
FIG. 21 illustrates a person in a lie down position using the exercising structure of FIGS. 1 and 10 to exercise, in accordance with embodiments of the present invention.

FIG. 21 illustrates a person 145 in a lie down position using the exercising structure 34 of FIGS. 1 and 10 to exercise, in accordance with embodiments of the present invention. The person 145 is shown using a leg 180 (a second leg may alternatively be used) to move the tubular structure 132 in a direction 202 against the preset amount of resistance supplied by the resistance means 135. Note that the tubular structure 132 may be moved by either leg 180 or leg 179 and in any direction with respect to the tubular structure 133. The exercise shown in FIG. 21 may be used to strengthen, inter alia, leg muscles, etc.

Figure 22:
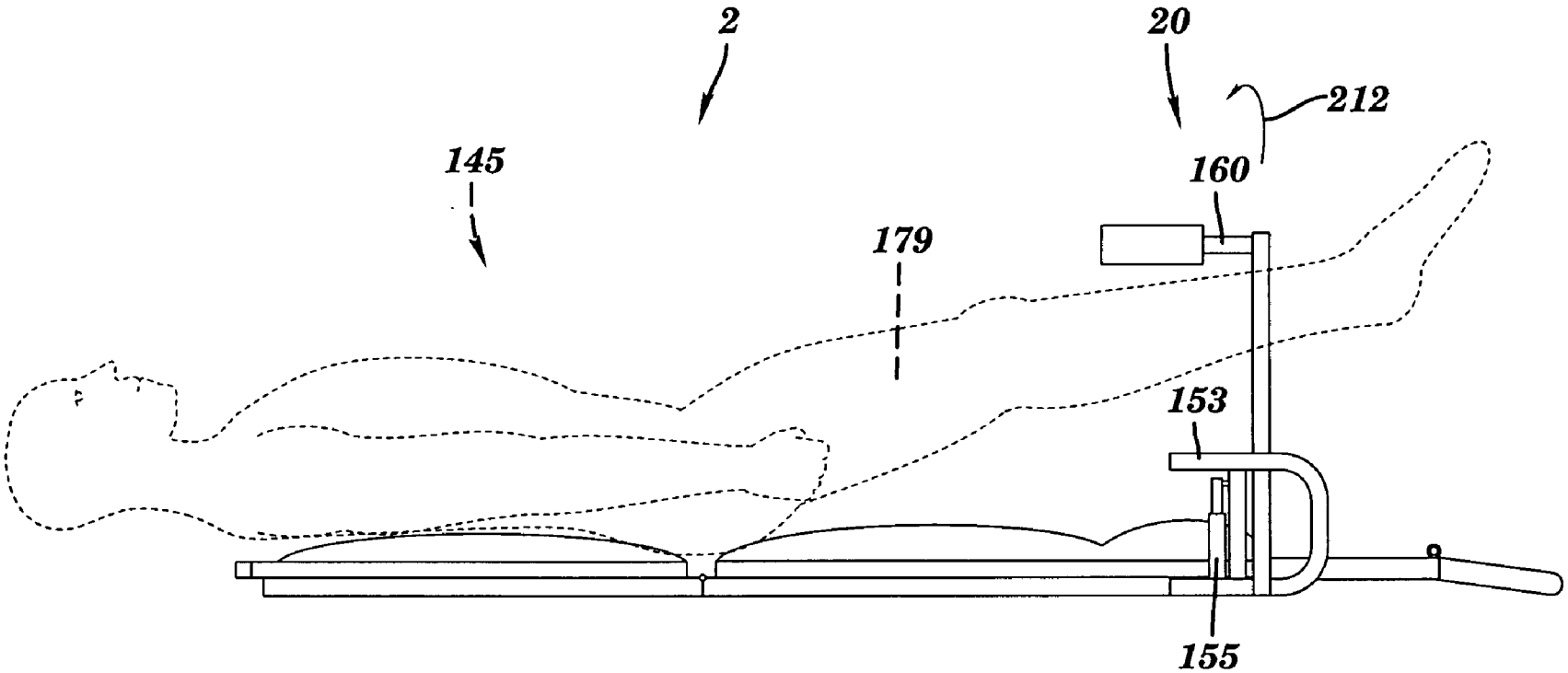
FIG. 22 illustrates a person in a lie down position using the exercising structures of FIGS. 1 and 5 to exercise, in accordance with embodiments of the present invention.

FIG. 22 illustrates a person 145 in a lie down position using the exercising structures 19 and 20 of FIGS. 1 and 5 to exercise, in accordance with embodiments of the present invention. The following description of exercising with the removably attachable exercising structure 20 also applies to exercising with the removably attachable exercising structure 19 of FIG. 1 (exercising simultaneously and in an opposite direction (i.e., opposite to direction 212) with a second leg). The person 145 is shown using a leg 180 to secure the adjustable extension device 94 to move the resilient structure 89 in the direction 210 against the preset amount of resistance supplied by the resistance means 37. Concurrently, the person 145 is shown using a leg 179 to secure the adjustable extension device 160 to move the resilient structure 153 in the direction 212 against the preset amount of resistance supplied by the resistance means 155. The exercise shown in FIG. 12 may be used to strengthen, inter alia, leg muscles, etc.

The portable exercise apparatus 2 (see FIGS. 1–22) of the present invention allows a person (e.g., person 145 of FIGS. 11–22) to exercise in many different locations including, inter alia, any room in a home, an automobile, a hospital, a hotel, etc. Additionally, the person may, inter alia, watch T.V., use a computer, talk on a telephone, etc. while exercising with the portable exercise apparatus 2. After an exercising routine is completed the person may remove any of the exercising structures 19, 20, 28, 29, 30, 31, 32, 33, 34, and 43 from the body support structure 4, remove the body support structure 4 from the support structure 14, fold the body support structure 4 (e.g., place the back support structure 10 about parallel to the sitting structure 8 with an angle of about 0° between the back support structure 10 and the sitting structure 8), and place the exercising structures 19, 20, 28, 29, 30, 31, 32, 33, 34, and 43 and the folded the body support structure 4 into a storage area (e.g., a closet) until the person 145 is ready to use the portable exercise apparatus 2 again. Thus, the portable exercise apparatus 2 is portable with respect to the support structure 14 because the portable exercise apparatus 2 can be readily removed from the support structure 14 and stored or transported easily to any desired location (e.g., any room in a home, an automobile, hotel room, hospital, etc.).

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A portable exercise apparatus comprising:

a body support structure comprising a sitting structure pivotally attached to a back support structure, wherein the back support structure is adapted to be positioned at a plurality of angular positions with respect to the sitting structure, wherein the body support structure is adapted to be placed on a supporting structure, wherein the back support structure comprises a first substantially flat structure mounted on a first side of a first frame, a first elongated member attached to the first frame, and a second elongated member attached to the first frame, and wherein the sitting structure comprises a second substantially flat structure mounted on a first side of a second frame, a third elongated member attached to the second frame, and a fourth elongated member attached to the second frame;

a first padding structure coupled to the first substantially flat structure and a second padding structure coupled to the second substantially flat structure;

a first padded structure mechanically attached to a second side of the first frame and a second padded structure mechanically attached to a second side of the second frame; and at least one exercising structure adapted to be removably attached to the body support structure, wherein the at least one exercising structure comprises a first structure movably attached to a second structure, a first attachment device, and a resistance means for applying a preset amount of resistance against movement of the first structure with respect to the second structure, wherein the attachment device is adapted to removably attach the second structure to the body support structure, and wherein the portable exercise apparatus is portable with respect to the supporting structure.

2. The portable exercise apparatus of claim 1, wherein the first structure is rotatably attached to the second structure.

3. The portable exercise apparatus of claim 1, wherein the body support structure is placed on the supporting structure, and wherein the supporting structure is selected from the group consisting of a couch and a chair.

4. The portable exercise apparatus of claim 1, wherein the body support structure is placed on the supporting structure, and wherein the supporting structure is a floor.

5. The portable exercise apparatus of claim 1, wherein the body support structure is placed on the supporting structure, and wherein the supporting structure is a wheel chair.

6. The portable exercise apparatus of claim 1, wherein the body support structure is placed on the supporting structure, and wherein the supporting structure is an automobile seat.

7. The portable exercise apparatus of claim 1, wherein the resistance means comprises at least one resistance band.

8. The portable exercise apparatus of claim 1, wherein the resistance means comprises at least one spring.

9. The portable exercise apparatus of claim 1, wherein the at least one exercising structure is removably attached to the first elongated member.

10. The portable exercise apparatus of claim 1, wherein the at least one exercising structure is removably attached to the second elongated member.

11. The portable exercise apparatus of claim 1, wherein the at least one exercising structure is removably attached to the third elongated member.

12. The portable exercise apparatus of claim 1, wherein the at least one exercising structure is removably attached to the fourth elongated member.

13. The portable exercise apparatus of claim 1, wherein the first substantially flat structure and the second substantially flat structure each comprise a material selected from the group consisting of wood, metal, and plastic.

14. The portable exercise apparatus of claim 1, further comprising a leg exercising structure, wherein the sitting structure comprises a fifth elongated member attached to the second frame, wherein the leg exercising structure is removably attached to the fifth elongated member, wherein the leg exercising structure comprises a third structure pivotally attached to an attachment structure, a fourth structure pivotally attached to the attachment structure, and a second resistance means for applying a preset amount of resistance against movement of the third structure and the fourth structure, and wherein the attachment structure is adapted to removably attach the leg exercising structure to the fifth elongated member.

15. The portable exercise apparatus of claim 1, further comprising a plurality of resistance bands, wherein the first elongated member, the second elongated member, the third elongated member, and the fourth elongated member each comprise a plurality of hooking devices adapted to removably attach each of said resistance bands to each of said elongated members.

16. The portable exercise apparatus of claim 15, wherein each of the plurality of hooking devices are selected from the group consisting of a hook and an eyelet.

17. A portable exercise apparatus comprising:

a body support structure comprising a sitting structure pivotally attached to a back support structure, wherein the back support structure is adapted to be positioned at a plurality of angular positions with respect to the sitting structure, wherein the body support structure is adapted to be placed on a supporting structure, wherein the back support structure comprises a first substantially flat structure mounted on a first side of a first frame, a first elongated member attached to the first frame, and a second elongated member attached to the first frame, and wherein the sitting structure comprises a second substantially flat structure mounted on a first side of a second frame, a third elongated member attached to the second frame, and a fourth elongated member attached to the second frame; and at least one exercising structure adapted to be removably attached to the body support structure, wherein the at least one exercising structure comprises a first structure movably attached to a second structure, a first attachment device, and a resistance means for applying a preset amount of resistance against movement of the first structure with respect to the second structure, wherein the attachment device is adapted to removably attach the second structure to the body support structure, wherein the portable exercise apparatus is portable with respect to the supporting structure, and wherein the second structure is an armrest structure removably attached to the third elongated member.

18. The portable exercise apparatus of claim 17, wherein the first structure is pivotally attached to the armrest structure.

19. A portable exercise apparatus comprising:

a body support structure comprising a sitting structure pivotally attached to a back support structure, wherein the back support structure is adapted to be positioned at a plurality of angular positions with respect to the sitting structure, wherein the body support structure is adapted to be placed on a supporting structure, wherein the back support structure comprises a first substantially flat structure mounted on a first side of a first frame, a first elongated member attached to the first frame, and a second elongated member attached to the first frame, and wherein the sitting structure comprises a second substantially flat structure mounted on a first side of a second frame, a third elongated member attached to the second frame, and a fourth elongated member attached to the second frame; and at least one exercising structure adapted to be removably attached to the body support structure, wherein the at least one exercising structure comprises a first structure movably attached to a second structure, a first attachment device, and a resistance means for applying a preset amount of resistance against movement of the first structure with respect to the second structure, wherein the attachment device is adapted to removably attach the second structure to the body support structure, wherein the portable exercise apparatus is portable with respect to the supporting structure, and wherein the second structure is an armrest structure removably attached to the fourth elongated member.

20. The portable exercise apparatus of claim 19, wherein the first structure is pivotally attached to the armrest structure.

21. A portable exercise apparatus comprising:

a body support structure comprising a sitting structure pivotally attached to a back support structure, wherein the back support structure is adapted to be positioned at a plurality of angular positions with respect to the sitting structure, wherein the body support structure is adapted to be placed on a supporting structure, wherein the back support structure comprises a first substantially flat structure mounted on a first side of a first frame, a first elongated member attached to the first frame, and a second elongated member attached to the first frame, and wherein the sitting structure comprises a second substantially flat structure mounted on a first side of a second frame, a third elongated member attached to the second frame, and a fourth elongated member attached to the second frame;

at least one exercising structure adapted to be removably attached to the body support structure, wherein the at least one exercising structure comprises a first structure movably attached to a second structure, a first attachment device, and a resistance means for applying a preset amount of resistance against movement of the first structure with respect to the second structure, wherein the attachment device is adapted to removably attach the second structure to the body support structure, and wherein the portable exercise apparatus is portable with respect to the supporting structure; and a third frame structure removably attached to the first elongated member and the second elongated member, wherein the third frame structure is adapted to be used for isometric exercises.

22. The portable exercise apparatus of claim 21, further comprising an accessory holding structure removably attached to the body support structure.

23. The portable exercise apparatus of claim 21, further comprising an elongated exercising structure removably attached to the body support structure, wherein the elongated exercising structure comprises a fifth structure slidedly attached to a sixth structure and a third resistance means for applying a preset amount of resistance against movement of the fifth structure with respect to the sixth structure.

24. The portable exercise apparatus of claim 21, further comprising:

a pivotally attachable exercising structure pivotally attached to the support structure, wherein the pivotally attachable exercising structure is adapted to be removably attached to the body support structure at a pivot point, and a fourth resistance means for applying a preset amount of resistance against movement of the pivotally attachable exercising structure with respect to the body support structure.

25. The portable exercise apparatus of claim 21, further comprising a joystick exercising structure removably attached to the body support structure, wherein the joystick exercising structure comprises a resistance spring pivotally attaching a first tubular structure to a second tubular structure, and wherein the resistance spring is adapted to apply a preset amount of resistance against movement of the first tubular structure with respect to the second tubular structure.

26. The portable exercise apparatus of claim 25, wherein the joystick exercising structure further comprises a third tubular structure perpendicularly attached to the first tubular structure, and wherein the third tubular structure is adapted to function as a handle for moving the first tubular structure with respect to the second tubular structure.

27. A method for exercising comprising:

providing a portable exercise apparatus comprising:

a body support structure, a first padding structure, a first padded structure, a second padded structure, and at least one exercising structure, wherein the support structure comprises a sitting structure pivotally attached to a back support structure, wherein the back support structure is adapted to be positioned at a plurality of angular positions with respect to the sitting structure, wherein the back support structure comprises a first substantially flat structure mounted on a first side of a first frame, a first elongated member attached to the first frame, and a second elongated member attached to the first frame, and wherein the sitting structure comprises a second substantially flat structure mounted on a first side of a second frame, a third elongated member attached to the second frame, and a fourth elongated member attached to the second frame, wherein the at least one exercising structure comprises a first structure movably attached to a second structure, a first attachment device, and a resistance means for applying a preset amount of resistance against movement of the first structure with respect to the second structure, wherein the first padding structure is coupled to first substantially flat structure and a second padding structure coupled to the second substantially flat structure, and wherein the first padded structure is mechanically attached to a second side of the first frame and the second padded structure is mechanically attached to a second side of the second frame;

placing the body support structure on a supporting structure, wherein the portable exercise structure is portable with respect to the supporting structure;

removably attaching by the first attachment device, the at least one exercising structure to the body support structure; and moving against a preset amount of resistance provided by the resistance means, the first structure with respect to the second structure.

28. The method of claim 27, wherein the first structure is rotatably attached to the second structure.

29. The method of claim 27, wherein the supporting structure is selected from the group consisting of a couch and a chair.

30. The method of claim 27, wherein the supporting structure is a floor.

31. The method of claim 27, wherein the supporting structure is a wheel chair.

32. The method of claim 27, wherein the supporting structure is an automobile seat.

33. The method of claim 27, wherein the resistance means comprises at least one resistance band.

34. The method of claim 27, wherein the resistance means comprises at least one spring.

35. The method of claim 27, further comprising removably attaching the at least one exercising structure to the first elongated member.

36. The method of claim 27, further comprising removably attaching the at least one exercising structure to the second elongated member.

37. The method of claim 27, further comprising removably attaching the at least one exercising structure to the third elongated member.

38. The method of claim 27, further comprising removably attaching the at least one exercising structure to the fourth elongated member.

39. The method of claim 27, wherein the first substantially flat structure and the second substantially flat structure each comprise a material selected from the group consisting of wood, metal, and plastic.

40. The method of claim 27, further comprising:

providing a leg exercising structure comprising a third structure pivotally attached to an attachment structure, a fourth structure pivotally attached to the attachment structure, and a second resistance means for applying a preset amount of resistance against movement of the third structure and the fourth structure, wherein the sitting structure comprises a fifth elongated member attached to the second frame;

removably attaching by a first attachment device, the leg exercising structure to the fifth elongated member; and moving against the preset amount of resistance provided by the second resistance means, the third structure and the fourth structure.

41. The method of claim 27, further comprising:

providing a plurality of resistance bands, wherein the first elongated member, the second elongated member, the third elongated member, and the fourth elongated member each comprise a plurality of hooking devices attached to each of said elongated members; and removably attaching at least one of said resistance bands to at least one of said hooking devices.

42. The method of claim 41, wherein each of the plurality of hooking devices are selected from the group consisting of a hook and an eyelet.

43. The method of claim 27, further comprising:

providing an accessory holding structure; and removably attaching the accessory holding means to the body support structure.

44. The method of claim 27, further comprising;

providing an elongated exercising structure comprising a fifth structure slidedly attached to a sixth structure and a third resistance means for applying a preset amount of resistance against movement of the fifth structure with respect to the sixth structure;

removably attaching the elongated exercising structure to the body support structure; and moving against the preset amount of resistance provided by the third resistance means, the fifth structure with respect to the sixth structure.

45. The method of claim 27, further comprising:

providing a pivotally attachable exercising structure and a fourth resistance means for applying a preset amount of resistance against movement of the pivotally attachable exercising structure with respect to the body support structure;

removably attaching the pivotally attachable exercising structure to the body support structure at a pivot point, and moving against the preset amount of resistance provided by the fourth resistance means, the pivotally attachable exercising structure with respect to the body support structure.

46. The method of claim 27, further comprising:

providing a joystick exercising structure comprising a resistance spring pivotally attaching a first tubular structure to a second tubular structure;

removably attaching joystick exercising structure to the body support structure; and moving against a preset amount of resistance provided by the resistance spring, the first tubular structure with respect to the second tubular structure.

47. The method of claim 46, further comprising:

providing a third tubular structure perpendicularly attached to the first tubular structure; and moving by the third tubular structure, the first tubular structure with respect to the second tubular structure.

48. The method of claim 27, further comprising:

removing the at least one exercising structure from the body support structure; and removing the body support structure from the supporting structure.

49. The method of claim 48, further comprising folding the body support structure for storage.

50. The method of claim 48, further comprising folding the body support structure for transfer to a second supporting structure.

51. A method for exercising comprising:

providing a portable exercise apparatus comprising:

a body support structure and at least one exercising structure, wherein the support structure comprises a sitting structure pivotally attached to a back support structure, wherein the back support structure is adapted to be positioned at a plurality of angular positions with respect to the sitting structure, wherein the back support structure comprises a first substantially flat structure mounted on a first side of a first frame, a first elongated member attached to the first frame, and a second elongated member attached to the first frame, wherein the sitting structure comprises a second substantially flat structure mounted on a first side of a second frame, a third elongated member attached to the second frame, and a fourth elongated member attached to the second frame, wherein the at least one exercising structure comprises a first structure movably attached to a second structure, a first attachment device, and a resistance means for applying a preset amount of resistance against movement of the first structure with respect to the second structure, and wherein the second structure is an armrest structure, and wherein the method further comprises;

placing the body support structure on a supporting structure, wherein the portable exercise structure is portable with respect to the supporting structure;

removably attaching by the first attachment device, the at least one exercising structure to the body support structure by removably attaching the armrest structure to the third elongated member; and moving against a preset amount of resistance provided by the resistance means, the first structure with respect to the second structure.

52. The method of claim 51, wherein the first structure is pivotally attached to the armrest structure.

53. A method for exercising comprising:

providing a portable exercise apparatus comprising:

a body support structure and at least one exercising structure, wherein the support structure comprises a sitting structure pivotally attached to a back support structure, wherein the back support structure is adapted to be positioned at a plurality of angular positions with respect to the sitting structure, wherein the back support structure comprises a first substantially flat structure mounted on a first side of a first frame, a first elongated member attached to the first frame, and a second elongated member attached to the first frame, wherein the sitting structure comprises a second substantially flat structure mounted on a first side of a second frame, a third elongated member attached to the second frame, and a fourth elongated member attached to the second frame, wherein the at least one exercising structure comprises a first structure movably attached to a second structure, a first attachment device, and a resistance means for applying a preset amount of resistance against movement of the first structure with respect to the second structure, wherein the second structure is an armrest structure, and wherein the method further comprises;

placing the body support structure on a supporting structure, wherein the portable exercise structure is portable with respect to the supporting structure;

removably attaching by the first attachment device, the at least one exercising structure to the body support structure by removably attaching the armrest structure to the fourth elongated member; and moving against a preset amount of resistance provided by the resistance means, the first structure with respect to the second structure.

54. The method of claim 53, wherein the first structure is pivotally attached to the armrest structure.

55. A method for exercising comprising:

providing a portable exercise apparatus comprising:

a body support structure, at least one exercising structure, and a third frame structure, wherein the support structure comprises a sitting structure pivotally attached to a back support structure, wherein the back support structure is adapted to be positioned at a plurality of angular positions with respect to the sitting structure, wherein the back support structure comprises a first substantially flat structure mounted on a first side of a first frame, a first elongated member attached to the first frame, and a second elongated member attached to the first frame, wherein the sitting structure comprises a second substantially flat structure mounted on a first side of a second frame, a third elongated member attached to the second frame, and a fourth elongated member attached to the second frame, wherein the at least one exercising structure comprises a first structure movably attached to a second structure, a first attachment device, and a resistance means for applying a preset amount of resistance against movement of the first structure with respect to the second structure, and placing the body support structure on a supporting structure, wherein the portable exercise structure is portable with respect to the supporting structure;

removably attaching by the first attachment device, the at least one exercising structure to the body support structure;

moving against a preset amount of resistance provided by the resistance means, the first structure with respect to the second structure;

removably attaching the third frame structure to the to the first elongated member and the second elongated member; and using the third frame structure for isometric exercises.

* * * * *

UNITED STATES PATENT AND TRADEMARK OFFICE

CERTIFICATE OF CORRECTION

PATENT NO. : 7,077,792 B2
APPLICATION NO. : 10/806807
DATED : July 18, 2006
INVENTOR(S) : Nerenberg It is certified that error appears in the above-identified patent and that said Letters Patent is hereby corrected as shown below:

On the Title Page in the Abstract item (57)
Line 4, delete "The a" and insert -- The --

Column 2
Lines 19 and 22, delete "of the"

Column 3
Line 17, delete "adapted be" and insert -- adapted to be --

Column 6
Line12 and 29, delete "know" and insert -- known --

Column 7
Line 34, delete the entire line

Signed and Sealed this

Fourteenth Day of November, 2006

JON W. DUDAS
*Director of the United States Patent and Trademark Office*